US012017107B2

(12) United States Patent
Ayala et al.

(10) Patent No.: US 12,017,107 B2
(45) Date of Patent: Jun. 25, 2024

(54) EXERCISE MACHINE BRAKE SYSTEM

(71) Applicant: Hydrow, Inc., Cambridge, MA (US)

(72) Inventors: Ray Ayala, Mansfield, MA (US); Joseph Carleo, Boston, MA (US); Adam Craft, Mansfield, MA (US); Emilie Hardel, Yarmouth, ME (US); Emily Hart, Watertown, MA (US); Tyler Hutchison, Durham, ME (US); Ryan Mullen, Brookline, MA (US)

(73) Assignee: Hydrow, Inc., Cambridge, MA (US)

( * ) Notice: Subject to any disclaimer, the term of this patent is extended or adjusted under 35 U.S.C. 154(b) by 0 days.

(21) Appl. No.: 17/564,883

(22) Filed: Dec. 29, 2021

(65) Prior Publication Data

US 2023/0201649 A1 Jun. 29, 2023

(51) Int. Cl.
*A63B 21/22* (2006.01)
*A63B 21/00* (2006.01)
(Continued)

(52) U.S. Cl.
CPC ..... *A63B 21/157* (2013.01); *A63B 21/0052* (2013.01); *A63B 21/0056* (2013.01);
(Continued)

(58) Field of Classification Search
CPC ..... A63B 2220/50; A63B 2220/51; A63B 2220/52; A63B 2220/53; A63B 2220/54; A63B 2220/56; A63B 2220/58; A63B 2220/30; A63B 2220/31; A63B 2220/34; A63B 2220/35; A63B 2220/36; A63B 2220/64; A63B 21/02; A63B 21/012; A63B 21/0125; A63B 21/015; A63B 21/018; A63B 21/008; A63B 21/00845; A63B 21/0085; A63B 21/0057; A63B 21/0056;
(Continued)

(56) References Cited

U.S. PATENT DOCUMENTS 17,001 A * 4/1857 Smith et al. ..... B27M 3/34 144/7
5,354,251 A * 10/1994 Sleamaker ..... A63B 21/4047 482/142
(Continued)

FOREIGN PATENT DOCUMENTS

KR 2018-0048118 5/2018
WO WO 2020-018955 1/2020

OTHER PUBLICATIONS

International Search Report and Written Opinion in International Application No. PCT/US2022/054179, dated May 10, 2023, 11 pages.
U.S. Appl. No. 17/001,285, filed Aug. 24, 2020, Wachirajindakul.

*Primary Examiner* — Megan Anderson
(74) *Attorney, Agent, or Firm* — Fish & Richardson P.C.

(57) ABSTRACT

An exercise machine includes a shaft configured to rotate about an axis; a spool configured to receive a strap and drive rotation of the shaft about the axis in response to movement of the strap; a flywheel configured to rotate about the axis; one or more conductive coils arranged to generate magnetic fields that induce eddy currents in the flywheel; a clutch configured to engage and disengage transmission of torque between the spool and the flywheel; and a spring arranged around the axis, the spring configured to exert a return torque on the spool about the axis in response to rotation of the shaft.

17 Claims, 17 Drawing Sheets

(51) Int. Cl.
*A63B 21/005* (2006.01)
*A63B 21/012* (2006.01)

(52) U.S. Cl.
CPC ..... *A63B 21/012* (2013.01); *A63B 21/151* (2013.01); *A63B 21/225* (2013.01); *A63B 21/00192* (2013.01); *A63B 21/005* (2013.01); *A63B 21/0057* (2013.01)

(58) Field of Classification Search
CPC ..... A63B 21/0059; A63B 21/0058; A63B 21/00192; A63B 21/005; A63B 21/0051; A63B 21/0052; A63B 21/0053; A63B 21/0054; A63B 21/22; A63B 21/222; A63B 21/225; A63B 21/227; A63B 21/157; A63B 21/158; A63B 21/159; A63B 21/151; A63B 21/153; A63B 22/0087; A63B 22/203; A63B 22/0076
USPC ..... 482/70
See application file for complete search history.

(56) References Cited

U.S. PATENT DOCUMENTS 5,409,435 A * 4/1995 Daniels ..... F16D 57/002 482/901
5,944,638 A * 8/1999 Maresh ..... A63B 22/0605 482/110
6,379,285 B1 * 4/2002 Maresh ..... A63B 22/0605 482/57
6,932,745 B1 8/2005 Ellis
9,643,044 B1 5/2017 Hsu
10,143,880 B1 * 12/2018 Boatwright ..... A63B 21/078
10,207,138 B2 * 2/2019 Hsu ..... F16F 9/535
10,471,297 B1 * 11/2019 Smith ..... A63B 22/0087
10,828,531 B1 * 11/2020 Smith ..... A63B 22/0076
10,981,624 B2 * 4/2021 Lin ..... H02K 1/187
11,179,590 B1 * 11/2021 Nicholas ..... A63B 21/0051
11,187,285 B2 * 11/2021 Wrobel ..... F16D 41/26
2002/0160887 A1 * 10/2002 Warner ..... A63B 22/0605 482/57
2009/0036276 A1 * 2/2009 Loach ..... A63B 21/15 482/72
2014/0113779 A1 * 4/2014 Loach ..... A63B 21/00069 310/105
2017/0197104 A1 * 7/2017 Turner ..... A63B 21/015
2020/0114753 A1 * 4/2020 Biderman ..... H02P 6/08
2020/0179780 A1 * 6/2020 Buckrell ..... A63B 71/0036
2020/0330817 A1 * 10/2020 Liu ..... A63B 22/0048
2021/0402246 A1 * 12/2021 Stegeman ..... A63B 21/16
2023/0053751 A1 * 2/2023 Lin ..... A63B 21/0056

* cited by examiner

EXERCISE MACHINE BRAKE SYSTEM

FIELD OF THE DISCLOSURE

The present disclosure relates to brake mechanisms for use in exercise and other machines.

BACKGROUND

Exercise machines, such as rowing exercise machines, can include adjustable mechanisms that are configured to provide varying user experiences, such as various resistance forces experienced by a user. Movement of components in exercise machines can be at least partially rotary, including rotation of at least one shaft.

SUMMARY

Some aspects of this disclosure describe a machine, such as an exercise machine. Some implementations of the machine include a shaft configured to rotate about an axis; a spool configured to receive a strap and drive rotation of the shaft about the axis in response to movement of the strap; a flywheel configured to rotate about the axis; one or more conductive coils arranged to generate magnetic fields that induce eddy currents in the flywheel; a clutch configured to engage and disengage transmission of torque between the spool and the flywheel; and a spring arranged around the axis, the spring configured to exert a return torque on the spool about the axis in response to rotation of the shaft.

Implementations of the machine can have any one or more of at least the following characteristics.

In some implementations, the shaft includes an integrally-formed shaft extending to each of the spool, the flywheel, and the spring.

In some implementations, the clutch is configured to engage and disengage transmission of torque between the shaft and the flywheel.

In some implementations, the clutch is arranged within a footprint of the flywheel.

In some implementations, the clutch engages with an outer circumference of the shaft.

In some implementations, the clutch is configured to engage and disengage transmission of torque between the shaft and the spool, and the spring is coupled to the spool over a torque transmission path that bypasses the shaft.

In some implementations, the spring is attached to the shaft.

In some implementations, the machine includes a handle coupled to the strap.

In some implementations, the spool is arranged between the flywheel and the spring.

In some implementations, the spool has a radius that increases in a winding direction of the strap on the spool.

In some implementations, the machine includes a rowing exercise machine.

In some implementations, the clutch is a one-way clutch.

In some implementations, the spring is a torsion spring.

In some implementations, the machine includes at least one encoder configured to measure rotation of at least one of the shaft or the flywheel.

Some aspects of this disclosure describe another machine, which can share characteristics with the previously-described machine. The other machine (e.g., an exercise machine) includes a brake shaft configured to rotate about a first axis; a spool configured to receive a strap and drive rotation of the brake shaft about the first axis in response to movement of the strap; a flywheel configured to rotate about the first axis; one or more conductive coils arranged to generate magnetic fields that induce eddy currents in the flywheel; a clutch configured to engage and disengage transmission of torque between the spool and the flywheel; and a spring configured to exert a return torque about a second axis in response to rotation of the brake shaft, wherein the second axis is different from the first axis.

Implementations of this machine can have some or all of the characteristics as described for the previous machine. Moreover, implementations of this machine can have any one or more of at least the following characteristics.

In some implementations, the machine includes a gear stage sprocket configured to rotate together with the brake shaft about the first axis; a spring shaft coupled to the spring, the spring shaft configured to rotate about the second axis; a return stage sprocket configured to rotate together with the spring shaft about the second axis, and a belt coupling the gear stage sprocket and the return stage sprocket.

In some implementations, the return stage sprocket has a larger radius than the gear stage sprocket.

In some implementations, the return stage sprocket has more teeth than the gear stage sprocket.

In some implementations, the machine includes a mechanical component holding the gear stage sprocket, the mechanical component pivotable with respect to the first axis to alter a distance between the first axis and the second axis.

In some implementations, the machine includes one or more locking components adjustable to lock a position of the mechanical component with respect to the first axis.

In some implementations, the machine includes a rowing exercise machine.

Implementations according to this disclosure can help to realize one or more advantages. In some implementations, calibration of a brake system can be simplified. In some implementations, calibration of the brake system can be more accurate/precise. In some implementations, a brake system can maintain precise operation over a longer period of time. In some implementations, wear on exercise machine components can be reduced. In some implementations, noise generated by an exercise machine can be reduced. In some implementations, a braking torque can be controlled more accurately and/or reliably. In some implementations, a number of spring rotations can be reduced, improving spring reliability and stability over time.

The details of one or more implementations are set forth in the accompanying drawings and the description below. Other aspects, features and advantages will be apparent from the description and drawings, and from the claims.

DETAILED DESCRIPTION

This disclosure relates to brake mechanisms for use in exercise and other machines. In some implementations, a user-driven spool, an eddy current-braked flywheel, and a return assembly (e.g., including a spring) are distributed so as to apply torques about a single primary axis of rotation. In some implementations, this arrangement can improve reliability, allow for more precise control and/or measurement, and provide other benefits as detailed in this disclosure. In some implementations, an off-axis return stage is configured to reduce a number of spring rotations, improving system durability.

Figure 1:
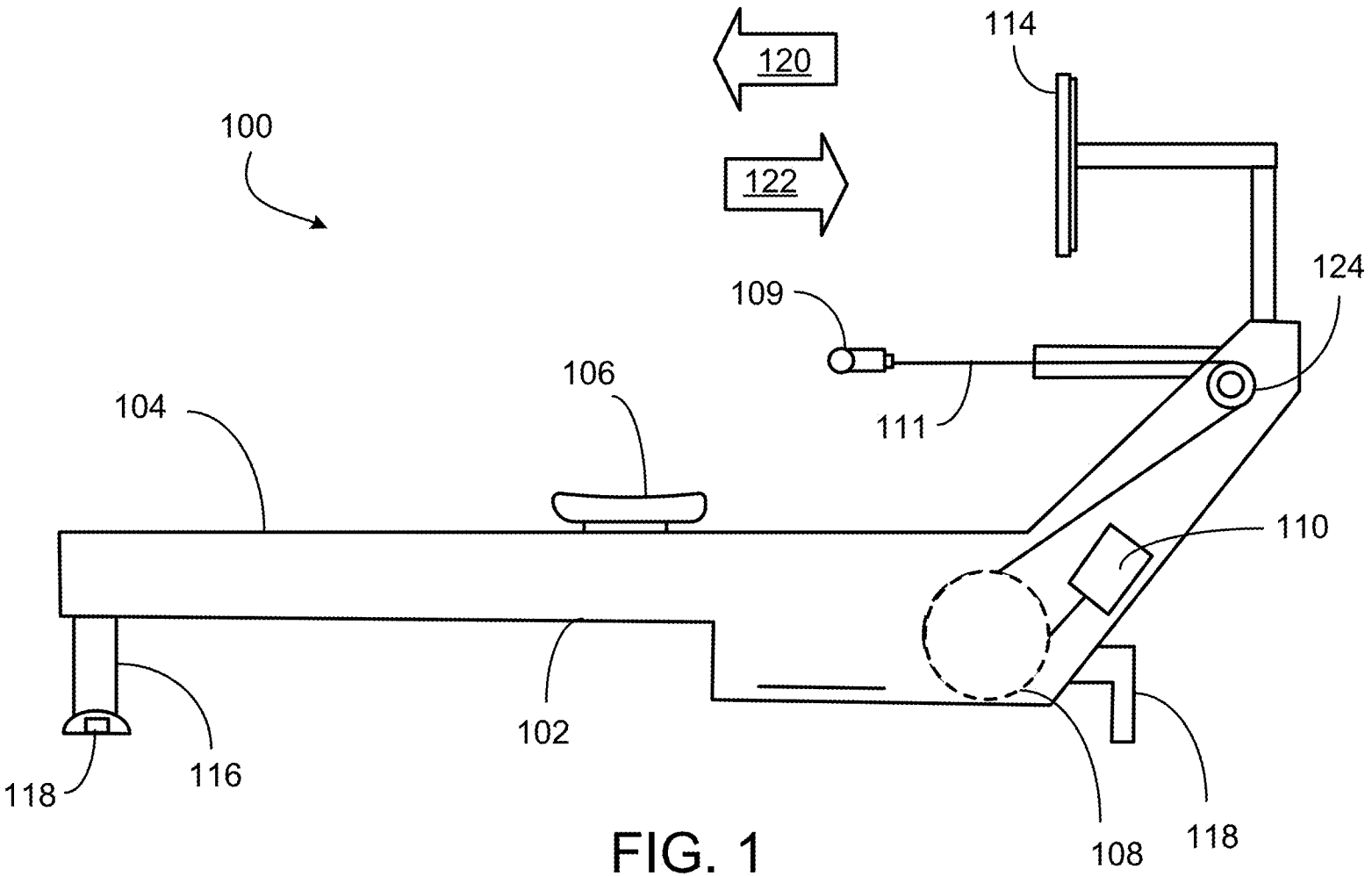
FIG. 1 is a diagram illustrating an example exercise machine.

As shown in FIG. 1, an example exercise machine 100 includes a chassis 102, a rail 104, a seat 106, a brake system 108 (e.g., a brake system described in this disclosure, such as a brake system configured to rotate about a single axis or a brake system having an off-axis return stage), a brake controller 110 that receives signals from and controls the brake system 108, a handle 109, a strap 111, a display 114 (e.g., a monitor such as a touchscreen display), legs 116, and ground contact points 118. In this example, the strap 111 is mechanically coupled to the brake system 108 over a roller 124. The example exercise machine 100 depicted in FIG. 1 is a rowing exercise machine, further details about which (excluding the brake system) can be found in U.S. Pat. No. 10,471,297, the entirety of which is hereby incorporated by reference. However, the brake systems of the present disclosure can be incorporated into other systems, including other exercise machines. For example, the brake systems can be incorporated into systems, such as exercise machines, in which it is desirable to impose an adjustable force on a handle or other component, and/or in which it is desirable to impose a return force on the handle or other component in a first direction after movement of the handle or other component in a second direction. For example, the brake systems can be incorporated into resistance machines such as leg press machines and seated arm exercise machines.

In a "drive" phase of the exercise machine 100, a user pulls the handle 109 in direction 120, causing movement of the strap 111 coupled to the brake system 108. The brake system 108, controlled by the brake controller 110, applies an opposing resistance force to the strap 111, as described in more detail below. In a "recovery" phase of rowing, the user allows the handle 109 to be pulled back in a direction 122, e.g., driven by a return assembly of the brake system 108 pulling on the strap 111. When the handle 109 has returned to its original position or another stroke-completion position, the rowing stroke is complete, and another drive phase begins.

Brake systems according to this disclosure, such as the brake system 108, can provide one or more of a variety of functionalities, depending on the implementation. In some implementations, the brake system is coupled to a user-driven control (e.g., the handle 109) so that motion of a user of the exercise machine causes corresponding movement (e.g., rotation) of one or more components of the brake system. In some implementations, the brake system is configured to apply variable braking forces (e.g., braking torques applied during a drive phase) to one or more components, e.g., in order to adjust a resistance faced by a user of the exercise machine and/or to simulate a scenario for the user of the exercise machine. In some implementations, the brake system is configured to return itself to a starting/neutral position (e.g., during a recovery phase), e.g., using a return assembly that can provide a force in a direction opposite a user-driven force. In some implementations, these various functionalities are integrated into motion along a single rotational axis, e.g., using a shaft coupled to multiple torque-applying assemblies.

Figure 2B:
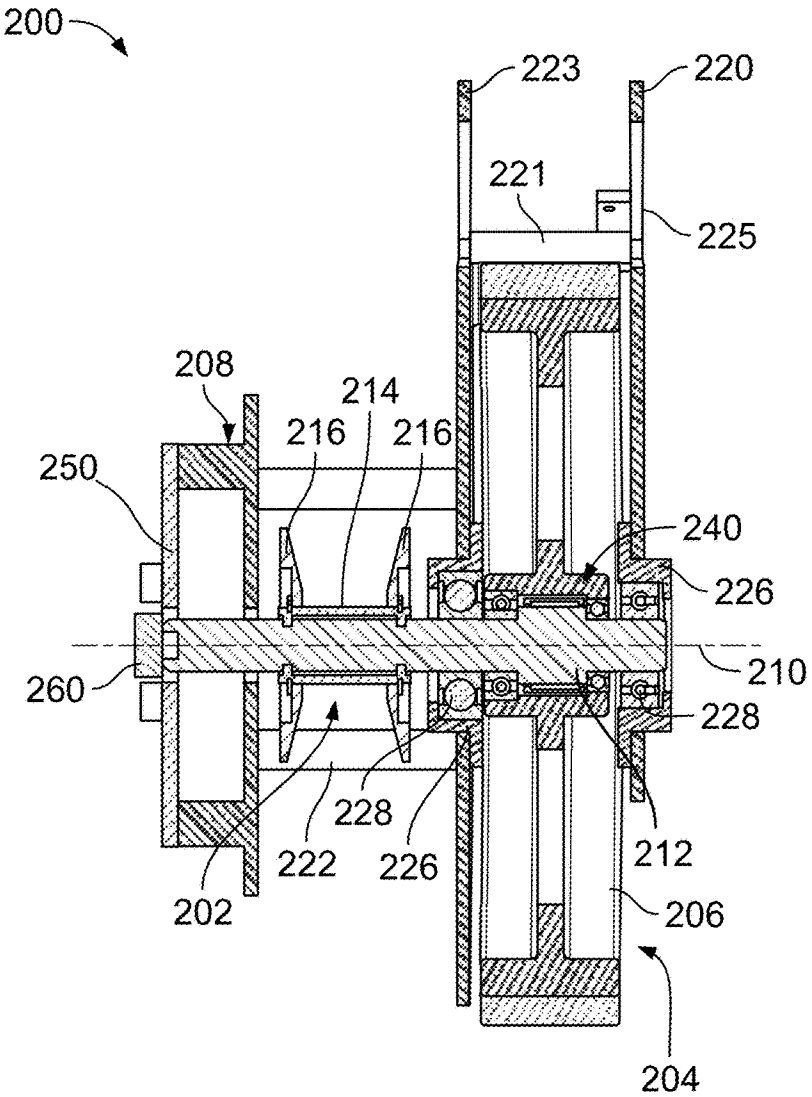
FIGS. 2A-2B are perspective and side views of an example direct drive brake system.
Figure 2A:
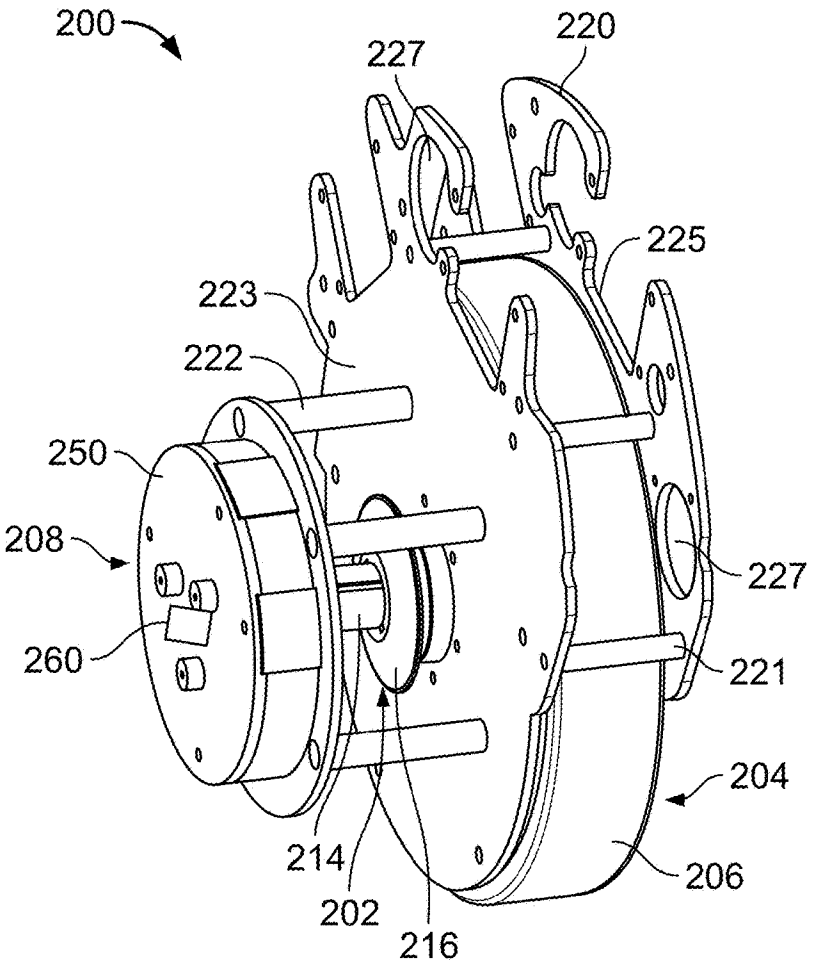

As shown in FIGS. 2A-2B, in some implementations, a direct drive brake system 200 includes three coupled assemblies. These assemblies are briefly described here, with further description of implementations of each assembly provided below. A spool assembly 202 is configured to rotate in response to an externally-applied force, e.g., in response to pulling of a strap (not shown) wound around the spool assembly 202. For example, when a user pulls a handle (e.g., of a rowing exercise machine, another type of exercise machine, or other equipment), the pulling causes rotation of at least part of the spool assembly 202.

A flywheel assembly 204 is mechanically coupled (in some implementations, by a switchable coupling such as a clutch) to the spool assembly 202. Magnetic fields can be applied to a flywheel 206 of the flywheel assembly 204 in order to cause resistance to motion of the flywheel 206 and, correspondingly, of the spool assembly 202.

A return assembly 208 is mechanically coupled to the spool assembly 202. The return assembly 208 is configured to apply torques that return the spool assembly to a starting/neutral position. For example, while and/or after a user of the rowing exercise machine 100 completes a drive phase of a stroke, the return assembly 208 can apply a torque that pulls the handle 109 back in the direction 122. In the return assembly 208, in some implementations, a spring is arranged around the axis about which the shaft and flywheel rotate.

In this example, the spool assembly 202, the flywheel assembly 204, and the return assembly 208 are each configured to apply torques about the same axis 210. For example, a spring of the return assembly 208 can be arranged around the axis 210, e.g., can be wound around the axis 210 and can wind around the axis 210 in response to rotation of the shaft 212. This can provide improvements in torque transmission, because potentially-lossy transmission elements, such as belt stages and gear stages, can be omitted. These stages can introduce variable and unpredictable torque changes and inefficiencies when transmitting user input to a flywheel and transmitting flywheel-induced torques back to the user. By contrast, in the direct drive brake system 200, a torque applied along the axis 210 is felt all along the axis 210. For example, in some implementations a shaft 212 extends to each assembly 202, 204, 208, mechanically coupling to each assembly 202, 204, 208 by components attached/arranged at the outer circumference of the shaft 212, as described in more detail below. This can simplify assembly and operation of the direct drive brake system 200, in some implementations reducing manufacturing costs and improving reliability of the direct drive brake system 200, e.g., because fewer separate components are included.

Off-axis return assemblies and/or flywheel assemblies can be coupled to a spool assembly by pulleys and rollers. However, these rollers can be associated with increased wear on connecting belts and/or with increased noise, such that decreasing the use of or eliminating off-axis rollers can reduce wear on the belts and/or reduce noise associated with movement of the belts and rotation of the rollers. Also, in some cases, off-axis rollers are separately calibrated (e.g., to set a belt tension), which can reduce an overall precision/reliability of brake control (e.g., a precision/reliability with which target forces can be applied to a strap pulled by a user). Off-axis assembly and/or roller arrangements can also be associated with deviation from a calibrated state over time, e.g., caused by loosening of belts. Reduction or elimination of off-axis rollers by locating assemblies along a common axis can accordingly improve the precision/reliability with which target resistance profiles can be set.

However, some implementations according to this disclosure do include an off-axis return stage, as described in further detail with respect to FIGS. 5A-5E.

The brake system 200 is "direct drive" in that transmission of torque between the spool 214, the shaft 212, and the flywheel 206 occurs without gearing reductions or belts that transmit torque to a second, different axis. Some implementations according to this disclosure, such as brake systems including the return assembly 500, include an off-axis return component; however, even when the return assembly 500 is used, the resulting brake system is direct drive because components related to the drive phase of a rowing stroke, and the dominant forces acting on the spool during the drive phase, are configured to rotate about a single axis, while off-axis rotation is related more to return (recovery phase) forces. However, for clarity, this disclosure generally uses "direct drive" to refer to implementations such as the brake systems 200 and 300, in which the spool, flywheel, and return assemblies are configured to rotate about a single axis without an off-axis rotational component.

Although the example direct drive brake system 200 shows all three assemblies 202, 204, 208 coupled by a shaft 212 that is an integrally formed component, in some implementations, the assemblies 202, 204, 208 are coupled by a shaft that is not integrally formed, e.g., that includes two or more components (e.g., metal portions) that extend along the axis 210. For example, the two or more components can be coupled at respective ends of the two or more components and/or overlap one another to form an overall shaft. The two or more components can be mechanically coupled (e.g., attached) so as to rotate together, e.g., with a matching angular velocity. In addition, although the example direct drive brake system 200 shows all three assemblies 202, 204, 208 arranged to apply torques and/or rotate about the same axis 210, in some implementations these assemblies are distributed across two or more axes. In some implementations, one or more rollers couple assemblies arranged along different rotational axes.

Referring in more detail to FIGS. 2A-2B, in the example direct drive brake system 200, the spool assembly 202 includes a spool 214 and two strap guides 216 on opposite sides of the spool 214. The spool 214 is attached to the shaft 212, e.g., welded to the shaft 212, bolted/screwed to the shaft 212, or otherwise attached to the shaft 212 such that rotation of the spool 214 translates directly to rotation of the shaft 212 with a matching angular velocity. In some implementations, a strap (not shown) is wound around the spool 214, e.g., wound around the spool 214 and attached to the spool 214 at one end of the strap, such as attached to a notch of the spool 214. "Strap," as used in this disclosure, refers at least to chains, chords, ropes, belts, leashes, webbings, toothed belts, v-belts, and combinations of them, and other extended coupling components that can transmit forces from one end to another. In some implementations, the strap deforms less than 5% under a tensile load of 1000 N. When a far end of the strap is pulled, a second end of the strap, attached to the spool 214, pulls the spool 214 and causes rotation of the spool 214; the strap wound around the spool 214 unwinds as the spool 214 rotates. Rotation of the spool 214 causes corresponding rotation of the shaft 212. The strap guides 216 (e.g., disks, posts, or other restraining elements) restrict movement of the strap, preventing the strap from becoming unspooled from the spool 214.

The shaft 212, such as a steel shaft, extends, on one side, to the flywheel assembly 204. The flywheel assembly 204 includes a frame 220 attached to standoffs 222 (e.g., posts, columns, and/or pillars). Additional standoffs 221 join two plates 223, 225 of the frame 220 arranged on opposite sides of the flywheel 206. Plate 223 defines a center aperture through which the shaft 212 is disposed to couple with the flywheel 206. The frame 220 is joined to two covers 226 that enclose ball bearings 228 maintaining separation between non-rotating portions of the flywheel assembly 204 (e.g., the frame 220, the covers 226, and magnets) and rotating components of the direct drive brake system 200, such as the shaft 212 and the flywheel 206, and that support the shaft 212. The ball bearings 228 allow for low-friction rotation of the rotating components. In some implementations, roller bearings and/or other bearing types are used instead of or in addition to the ball bearings 228. The ball bearings 228 can be formed of metal (e.g., steel), a ceramic, and/or another hard and resilient material. In some implementations, the covers 226 incorporate seals to reduce or prevent intrusion of dust and other contaminants inside the covers 226, where the dust and other contaminants might interfere with low-friction rotation. The frame 220 can include mounting features 227 such as apertures, threaded inserts, hooks, and/or other portions that can be attached to the chassis 102 to secure the frame 220 in position.

The flywheel 206 (sometimes referred to as a "disk," such as an "eddy current brake disk") is an electrically conductive rotating element that is mechanically coupled (e.g., switchably mechanically coupled) to the shaft 212. One or more magnets (not shown in FIGS. 2A-2B), such as electromagnets, are arranged in proximity to the flywheel 206 so as to generate magnetic fields that act upon the flywheel 206. When the flywheel 206 rotates within the frame 220 (e.g., driven by the shaft 212), eddy currents are generated in the flywheel 206 in response to the magnetic fields, and interactions between the eddy currents and the magnetic fields lead to a torque on the flywheel 206 opposite a direction of motion of the flywheel 206, e.g., a braking force on the flywheel 206. This braking force is transferred from the flywheel 206 to the shaft 212, in some implementations via a clutch. When a strength of the magnetic fields is adjustable (e.g., when the one or more magnets include an electromagnet that generates magnetic fields proportional to current through the electromagnet), the strength can be adjusted so as to produce a target braking torque on the shaft 212 and, accordingly, a target resistance force on the strap/handle. For example, the target braking torque can be selected in accordance with a resistance profile to be felt by (imposed on) an operator of an exercise machine, e.g., to simulate a particular exercise scenario.

Dimensions of the flywheel 206 can vary depending on the implementation. In some implementations, the flywheel 206 has a diameter between 4 inches and 24 inches. In some implementations, the flywheel 206 has a thickness between 0.25 inches and 3 inches. In some implementations, as shown below, the flywheel 206 defines one or more apertures, e.g., to reduce a mass (and, correspondingly, a moment of inertia) of the flywheel 206. The diameter, thickness, and geometric aspects of the flywheel 206 (e.g., any apertures in the flywheel 206, and/or an overall shape of the flywheel 206, which need not be a disk), along with densities of one or more materials that make up the flywheel 206, determine a rotational inertia of the flywheel 206, which in turn determines a braking torque applied for a given set of motion and magnetic field conditions.

The flywheel 206, in various implementations, can include one or more of various materials, such as iron (e.g., cast iron), steel, aluminum, and/or one or more other metals (e.g., titanium). The flywheel 206 need not be composed entirely of electrically conducting materials but, rather, can include one or more non-conductive materials such as plastics and/or rubbers. The flywheel 206 can be integrally formed and/or can include multiple joined portions (e.g., joined by screws and/or bolts, and/or adhered (e.g., welded) to one another) that rotate with one another, e.g., as described for flywheel 310 in reference to FIG. 3A. In various implementations, the flywheel 206 can be ferromagnetic or non-ferromagnetic.

In some implementations, the flywheel assembly 204 includes a clutch configured to engage and disengage transmission of torque between the shaft 212 and the flywheel 206. In the operational context of rowing exercise machines, this functionality can be useful for various reasons. For example, it may be desirable to use the flywheel 206 to impose a resistance on the strap during a drive phase but not during a recovery phase. Accordingly, the torque transfer can be disengaged at the end of the drive phase. Relatedly, the flywheel 206 builds up momentum during rotation and, in some implementations, cannot be immediately stopped/reversed, such that disengagement of the shaft 212 conveniently allows for quick changes in rotation direction of the shaft 212, such as at the end of the drive phase or at another time.

In some implementations, as shown in FIG. 2B, the clutch is a one-way clutch 240 such as a roller clutch, a ratchet clutch, a sprag clutch, or a needle-bearing clutch. A one-way clutch between a first component and a second component is configured so that, when the first component is initially stationary, the second component can move freely and independently when rotating in one direction, but transfers torque to the first component (e.g., causes equal rotation of the first component) when rotating in the other direction. In some implementations, the two components are disengaged when the second component rotates with greater angular velocity than the first component in one direction, and engaged otherwise. For example, this functionality can be based on interlocking mechanical elements (e.g., teeth or rollers) that couple rotation in a first direction while decoupling rotation in a second direction. In the direct drive brake system 200, the one-way clutch 240 is configured to engage transmission of torque between the shaft 212 and the flywheel 206 for rotation of the shaft 212 in a first direction (e.g., a direction corresponding to a drive phase of a stroke), and to disengage transmission of torque between the shaft 212 and the flywheel 206 for rotation of the shaft 212 in a second, opposite direction (e.g., a direction corresponding to return motion of a handle/strap during a recovery phase of the stroke).

The clutch need not be a one-way clutch. For example, in some implementations the clutch is a controlled clutch such as an electromagnetic clutch or a hydraulic clutch. In response to a control signal (e.g., a mechanical control signal, a hydraulic control signal, a vacuum signal, or an electrical control signal, such as from the brake controller 110), the clutch can be configured to engage/disengage torque transfer between the shaft 212 and the flywheel 206. For example, in response to the control signal, a clutch plate or clutch cone can be repositioned (e.g., engaged or withdrawn), such as to engage or disengage transmission of torque. In some implementations, a brake controller (e.g., brake controller 600) is configured to apply the control signal, e.g., in response to detecting that a drive phase of handle movement has begun or is about to begin. Mechanical, hydraulic, pneumatic, and electromagnetic clutches, including single-plate and multi-plate clutches, wet and dry clutches, tooth clutches, and other clutch types, are each within the scope of this disclosure.

One or more mechanical/positional aspects of the shaft-clutch-flywheel coupling can provide various advantages. In some implementations, as shown in FIG. 2B, the clutch is arranged within a footprint of (e.g., concentrically within) the flywheel 206. In some implementations, the clutch engages with an outer circumference of the shaft 212. In some implementations, the clutch engages with an inner edge of the flywheel 206. In some implementations, the clutch is arranged to transfer torque around an axis that is common with an axis associated with spool assembly rotation, return assembly rotation, or both. For example, in some implementations the clutch can directly engage the shaft 212 to the flywheel 206, where the shaft 212 is directly driven in the spool assembly by movement of the strap. In some cases, one or more of these mechanical/positional features can simplify brake system design, reduce brake system complexity/cost, and improve reliability of the brake system by coupling together relevant components more directly.

On an opposite side of the spool assembly 202 from the flywheel assembly 204, the return assembly 208 includes a return housing 250 attached to the flywheel assembly 204 (e.g., to the frame 220) by the standoffs 222. The return housing 250 defines an aperture through which the shaft 212 is disposed to couple to a return mechanism inside the return housing 250. The return mechanism (e.g., a spring), not shown in FIGS. 2A-2B but described in more detail at least with respect to FIGS. 3D and 3G, is configured to apply a return torque on the shaft 212, which extends into the return housing 250. For example, in some implementations the return torque is applied directly by a spring over the common direct drive brake system axis without intermediate torque transmission over a second axis. The return torque is in a return direction opposite a drive direction of rotation of the shaft 212, where rotation in the drive direction is caused by pulling on the strap. In some implementations, an energy storage mechanism of the spool assembly 202 (e.g., a spring) is "charged up" with energy provided by rotation of the shaft 212 in the drive direction (e.g., the spring is wound up), and this energy is subsequently released to drive the shaft in the return direction. For example, the return torque can be in a same return direction as a braking torque applied by the flywheel 206. In some implementations, the flywheel 206 is disengaged from the shaft 212 when the shaft 212 is rotating in this opposite direction (e.g., disengaged by a clutch during a recovery phase of a stroke), and the return torque is maintained during this time by the return mechanism. The return housing 250 protects internal aspects components of the return assembly 208, such as the spring and, in some implementations, a sensor and/or other encoder component, from infiltration of dust and other contaminants.

In some implementations, a direct drive brake system includes one or more sensors. For example, the direct drive brake system 200 includes a shaft sensor 260 arranged at one end of the shaft 212. The shaft sensor 260 includes an encoder configured to measure absolute and/or relative (incremental) angular velocity and/or position of the shaft 212. For example, in some implementations, the shaft sensor 260 includes an electromechanical rotary encoder that is mechanically coupled to the shaft 212, e.g., by multiple contacts in a coded arrangement. In some implementations, the shaft sensor 260 includes an optical encoder that detects position and/or angular velocity of the shaft 212 based on light shining through and/or reflected from a code disk and detected at one or more photodetectors of the optical encoder. The code disk rotates with the shaft 212 (e.g., is mounted on the shaft 212), and different patterns of illumination shining through the code disk correspond to different rotary positions of the shaft 212. Measurements over multiple time points can be used to determine angular velocity of the shaft 212.

In some implementations, the shaft sensor 260 includes a magnetic encoder that detects position and/or angular velocity of the shaft 212. A code disk rotates with the shaft 212 (e.g., is mounted on the shaft 212), the code disk having multiple magnetic poles. One or more magnetic field sensors of the shaft sensor 260 (e.g., included in a circuit on a PCB of the shaft sensor 260) detect magnetic field changes caused by rotation of the code disk, and the magnetic field changes are used to determine position and/or angular velocity of the code disk and, correspondingly, the shaft 212. In some implementations, the magnetic field sensors include Hall effect sensors and/or magnetoresistive sensors.

Other types of encoders are also within the scope of this disclosure, such as capacitive encoders.

Besides the encoder itself, in some implementations the shaft sensor 260 includes one or more connection components by which measurements taken by the shaft sensor 260 can be transmitted to other components, such as to brake controller 110. For example, the shaft sensor 260 can be communicatively coupled to the brake controller 110 by a wired connection (e.g., by one or more electrical and/or optical cables) and/or by a wireless connection (e.g., a local wireless connection such as a Bluetooth wireless connection). As described in more detail below, the brake controller 110 can use position/velocity information from the shaft sensor 260 to determine information about rotation of the shaft 212 and perform corresponding operations, such as displaying information derived from the angular velocity of the shaft 212 (e.g., converted into an equivalent rowing speed) on the display 114 and controlling a braking resistance applied by the flywheel 206 based on the information about the rotation of the shaft 212. In some implementations, the shaft sensor 260 includes an embedded power source, e.g., a battery. In some implementations, the shaft sensor 260 is instead or additionally powered by an external power connection, such as powered by the brake controller 110 via an electrical cable. One or more components of the shaft sensor 260 can be mounted on a substrate such as a printed circuit board (PCB).

When two or more assemblies of the spool assembly 202, the flywheel assembly 204, and the return assembly 208 are arranged to rotate about a single axis such as axis 210, readout of rotational information of the direct drive brake system can be simpler than in alternative implementations in which more rotational axes are present, because measurement of rotation of one component applies to all components rotating with the one component on the same axis. For example, for the direct drive brake system 200, the shaft sensor 260 can be used to measure rotational information of the spool assembly 202 (e.g., a speed with which a user is pulling a strap), rotational information of the flywheel assembly 204 (e.g., a rotational speed of the flywheel 206 when the flywheel 206 is rotating with the shaft 212), and rotational information of the return assembly 208 (e.g., an extent to which a spring of the return assembly 208 has been wound up by rotation of the shaft 212, and/or an extent/speed with which the spring is rotating the shaft 212 in the reverse direction). Putting one or more of the assemblies 202, 204, 208 on an alternative rotational axis can, in some cases, mean either or both of (i) including additional dedicated sensors to measure rotation on the alternative axis, or (ii) estimating rotation on the alternative axis based on measured rotation on a primary axis, an estimation that might be inaccurate due to slippage, changing strap/belt tension over time, etc.

In some implementations, one or more other sensors are included besides the shaft sensor 260. For example, in some implementations another sensor (e.g., a sensor including an encoder) is configured to measure rotation of the flywheel 206 independently from rotation of the shaft 212. For example, the other sensor can be arranged within the frame 220. This can allow for rotational measurement of the flywheel 206 even when the flywheel 206 is uncoupled from the shaft 212. Moreover, in some implementations an equivalent sensor to the shaft sensor 260 (e.g., a sensor configured to measure rotation of the shaft 212) can be positioned differently from the shaft sensor 260, such as in or adjacent to the spool assembly 202, in or adjacent to the flywheel assembly 204, and/or in another location.

FIGS. 3A-3F show schematics of an example direct drive brake system 300. The direct drive brake system 300 shares the same basic arrangement as the direct drive brake system 200, such as a flywheel assembly, a spool assembly, and a return assembly arranged in that order and having components configured to rotate about a shared axis by coupling with a shaft 328 extending through all three assemblies. In some implementations, components of the direct drive brake system 300 can (but need not) have the same characteristics as same-named components of the direct drive brake system 200 (e.g., materials, function, arrangement, and/or configuration), except where indicated otherwise.

Figure 3A:
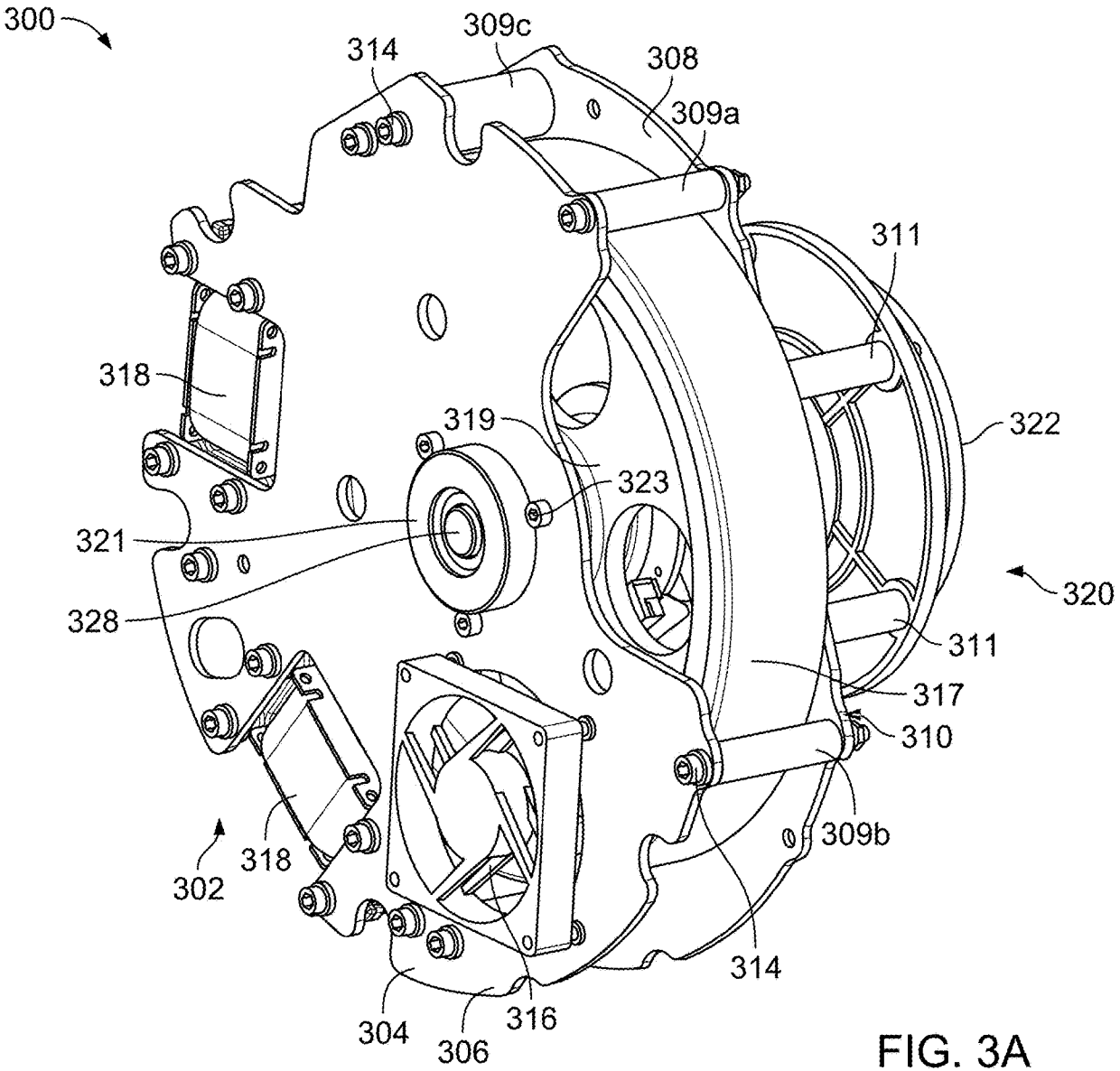
FIGS. 3A-3H are diagrams illustrating an example direct drive brake system.

FIG. 3A shows the direct drive brake system 300 with a flywheel assembly 302 in the foreground. The flywheel assembly 302 includes a frame 304 (e.g., as described for frame 220) having two plates 306, 308 (e.g., as described for plates 223, 225) joined by standoffs 309 (e.g., as described for standoffs 221). In some implementations, some standoffs, such as standoff 309*c*, includes a circumferential collar so as to have a wider diameter than other standoffs 309*a*, 309*b*. This can help maintain the two plates 306, 308 parallel to one another. The two plates 306, 308 are disposed on opposite sides of a flywheel 310 (e.g., as described for flywheel 206) that defines apertures 312. An assortment of screws/bolts (e.g., screws/bolts 314) are configured to join components of the direct drive brake system 300, e.g., join the plates 306, 308 to the standoffs 309. The flywheel assembly 302 is mounted, by further standoffs 311 attached to plate 308, to a return assembly 320, which is described in further detail below.

The flywheel 310 includes an outer, circumferential collar (rim) 317 and an inner plate (hub) 319 defining multiple apertures. In some implementations, the collar 317 acts as a primary magnetic component of the flywheel 310; the collar 317 has more mass than the inner plate 319 and is more affected by applied magnetic fields than the inner plate 319. Including more mass in the collar 317 than in the inner plate 319 increases the moment of inertia of the flywheel 310 compared to if the same total mass were distributed more in the inner plate 319, without increasing a total mass of the flywheel 310. Also, the collar 317, being (in some implementations) thicker than the inner plate 319, provides a low impedance return path for eddy currents.

Several components of the flywheel assembly 302 are shown in FIG. 3A that were not explicitly shown in FIGS. 2A-2B, though the direct drive brake system 200 can, in some implementations, include the same or equivalent components. A fan 316 is mounted on plate 306 and has vent access to an inside of the frame 304 through an aperture in the plate 306. During operation of the direct drive brake system 300, the fan 316 rotates to cool an interior of the frame 304, including the flywheel 310. Eddy currents generated in the flywheel 310 tend to heat the flywheel 310 by resistive dissipation, and the heat can cause mechanical damage to the flywheel assembly 302 and/or alter rotational control characteristics of the flywheel 310 (e.g., braking torques corresponding to given applied magnetic fields) due to a temperature-dependent resistivity of the flywheel 310. Cooling by the fan 316 can help maintain a stable temperature of the flywheel 310 to help maintain stable operation. Other elements, if present, can also be cooled by the fan 316, such as sensing elements (e.g., encoder(s)), the magnets 318 (which may be heated by, for example, resistive heating through currents flowing the electromagnets), and control electronics (e.g., brake controller 600, or a portion thereof, positioned at the flywheel assembly 302). In some implementations, the fan 316 is actively controlled, such as to operate at varying fan speeds based on cooling needs and/or to turn on/off based on cooling needs. Active control can be performed, for example, by the brake controller 600, and can be based on one or more temperature sensors (e.g., thermocouples) included in the flywheel assembly 302.

Two magnets 318—in the example of FIG. 3A, including conducting coils—are arranged around a periphery of the flywheel 310, such that, when currents are applied to the magnets 318, magnetic fields are generated at the flywheel 310. In some implementations, as shown in FIG. 3A, each magnet 318 includes a casing (e.g., an insulating casing such as a plastic or rubber casing) enclosing a wire coil. The currents can be applied, for example, by the brake controller 110, Modulation of the currents alters magnitudes of the magnetic fields and, correspondingly, braking torques applied by the flywheel 310.

Number, type, and arrangement of the magnet(s) that apply magnetic fields to the flywheel can vary depending on the implementation. For example, a number of the magnets (e.g., a number of coils in the vicinity of the flywheel 310) can be one, two, three, or more. Magnets can include permanent magnets (e.g., ferrite magnets, ceramic magnets, and/or rare earth magnets such as neodymium magnets) and/or electromagnets such as the coils of the magnets 318. When the magnets include permanent magnets, strength of the magnetic field(s) applied to the flywheel can be modulated by moving the permanent magnets toward and away from the flywheel. The magnets can be located in various positions and have various orientations. For example, the magnets can be oriented to produce magnetic fields perpendicular to a rim of the flywheel. In some implementations, the magnets are located at various points around a circumference of the flywheel and/or on opposite sides of the flywheel (e.g., opposite from one another along a diameter of the flywheel, and/or on the two axial sides of the flywheel).

A cover 321 is attached to plate 306 by fasteners 323. The cover 321 encloses one or more bearings that maintain separation with and support the shaft 328, as described in reference to covers 226.

Figure 3B:
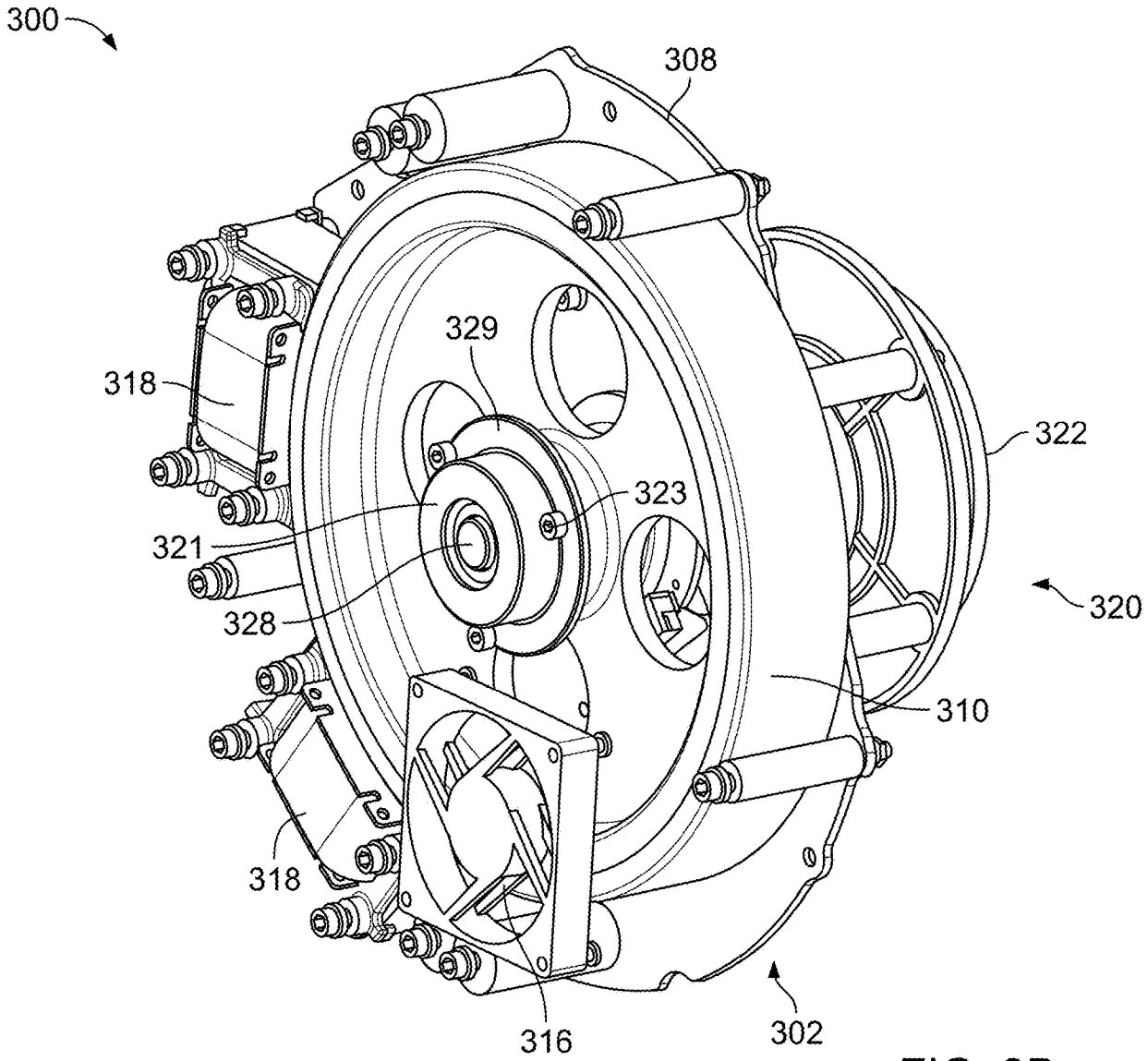

FIG. 3B shows the direct drive brake system 300 as described in FIG. 3A with plate 306 removed to show an interior of the frame 304. An inner flange 329 of the cover 321 receives the fasteners 323 to fix the cover 321 to the plate 306.

Figure 3C:
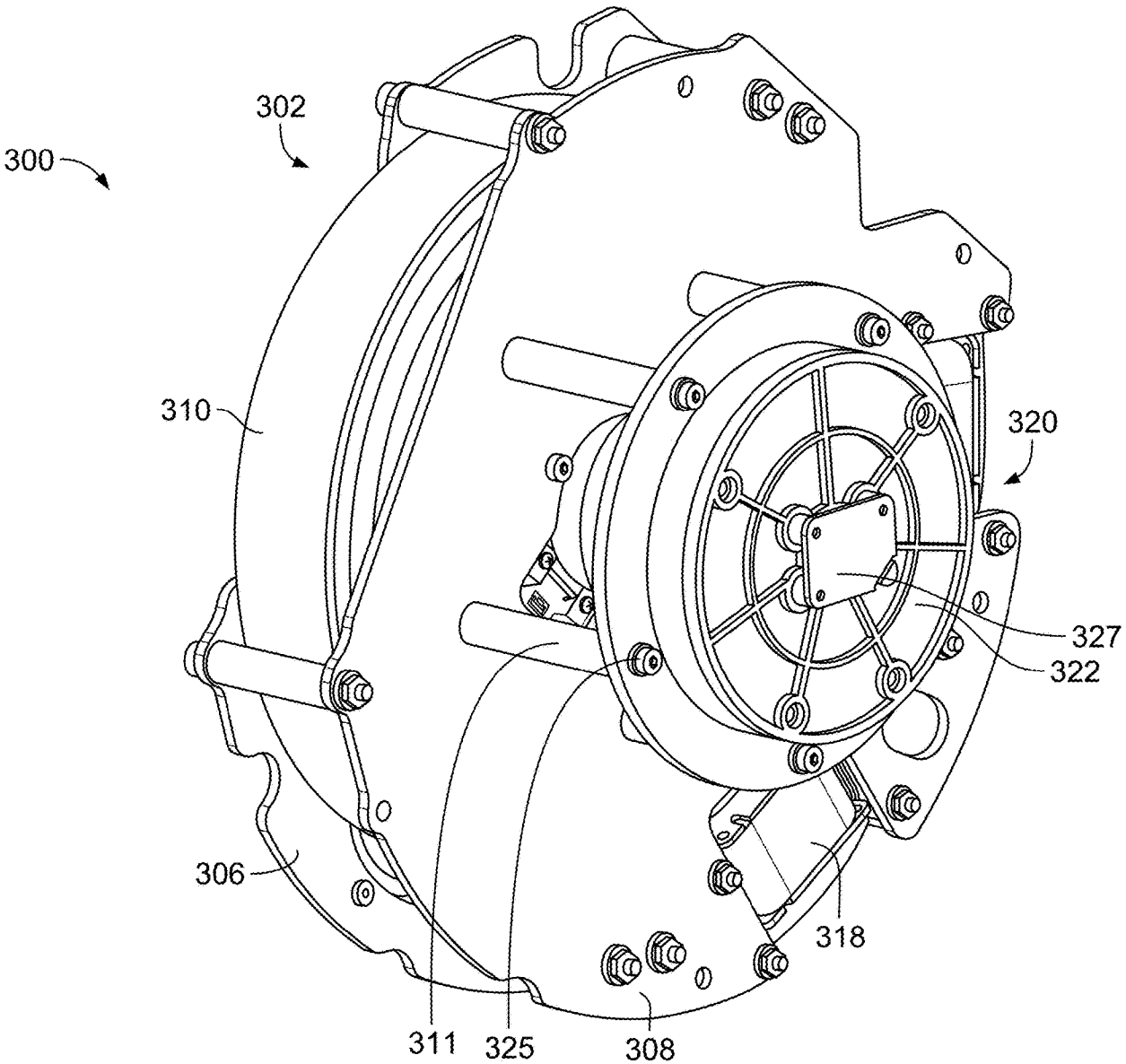
Figure 3D:
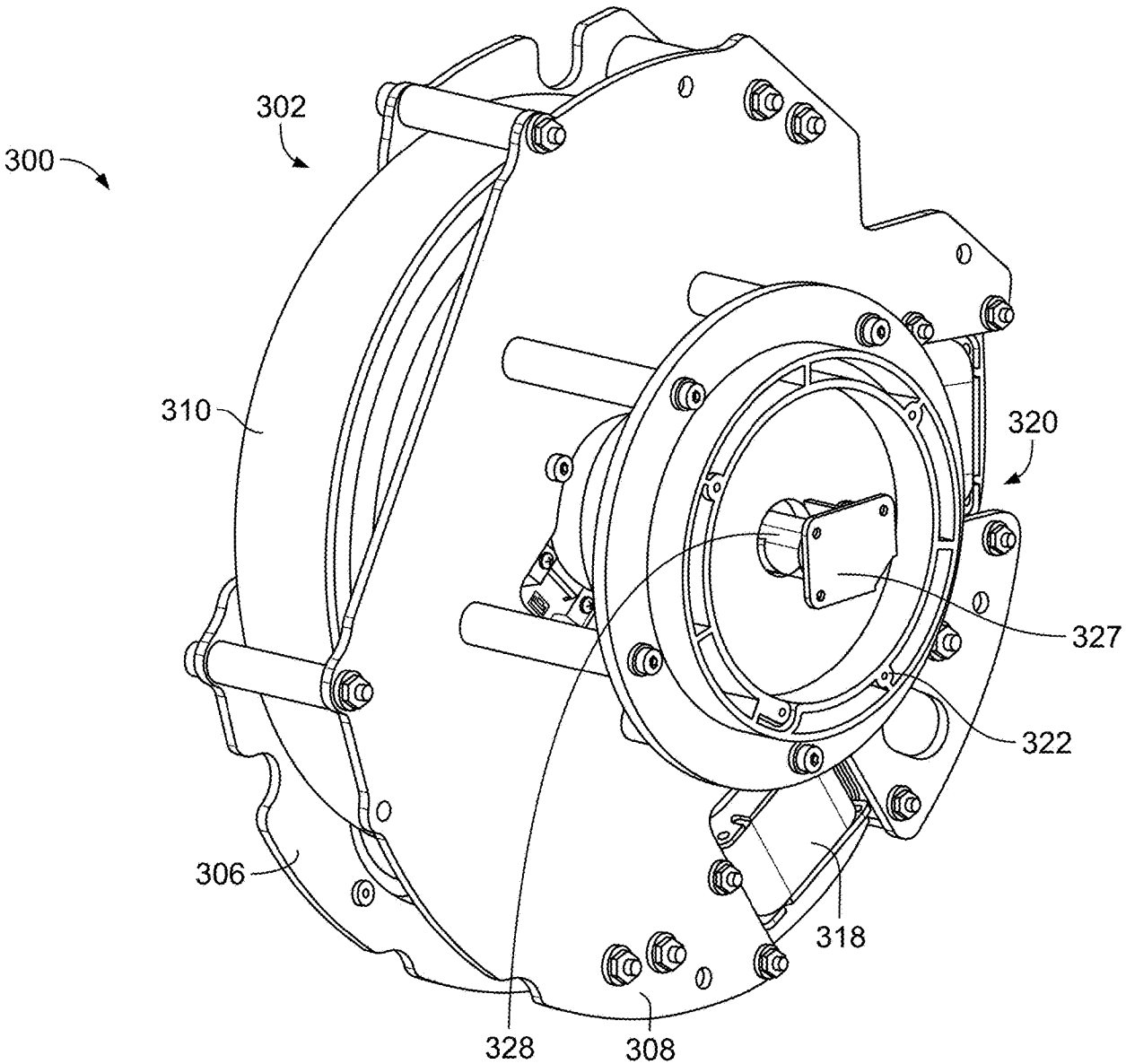

FIG. 3C shows the direct drive brake system 300 with the return assembly 320 in the foreground. A return housing 322 (e.g., as described for return housing 250) contains a spring 326, as shown in FIG. 3G below. A shaft sensor 327 (e.g., as described for shaft sensor 260) is mounted on the return housing 322 so as to remain at least partially stable during rotation of the shaft 328. For example, a PCB of the shaft sensor 327 (e.g., including measurement electronics such as optical sensors) is mounted on the return housing 322 and does not rotate with the shaft 328, and a second portion of the shaft sensor 327 (e.g., a code disk) rotates with the shaft 328 to permit measurement of rotation of the shaft 328. In this example, the second portion of the shaft sensor 327 is a magnet 333 (shown in FIGS. 3E-3F) whose rotation (as detected by sensor the magnetic field of the magnet 333) indicates rotation of the shaft 328. The return housing 322 can be formed from one or more materials depending on the implementation, such as metal(s) and/or plastic(s). Standoffs 311 are attached to the return housing 322 by screws (e.g., screw 325) and are also attached to the frame 304 (to plate 308) of the flywheel assembly 302.

FIG. 3D shows the direct drive brake system 300 with an outer plate of the return housing 322 removed, to expose an interior of the return housing 322. A spring inside the return housing 322 (not shown here, but shown and described in reference to FIG. 3G as spring 326) is mechanically coupled to (e.g., attached to) the shaft 328 that rotates along the single axis of the direct drive brake system 300. For example, a first end of the spring 326 is attached to the shaft 328, and a second, opposite end of the spring is attached to the return housing 322 (e.g., fixed in position). In the direct drive configuration, the spring 326 is arranged around the shaft 328 and around the common axis of the direct drive brake system 300. The spring 326 is configured to apply return torques directly on the common axis (e.g., directly to the shaft 328), without the return torque being transferred to the common axis from a second, different axis. The spring 326 can be attached to an end of the shaft 328 and/or to an outer circumference of the shaft 328. Because of the mechanical coupling between the spring 326 and the shaft 328, when the shaft 328 rotates (e.g., rotates in a drive direction), the spring 326 is wound up, storing potential energy in the spring 326. This potential energy is released when the shaft 328 is allowed to rotate in an opposite direction (e.g., a return direction), driving rotation of the shaft 328 in the opposite direction.

As shown in FIG. 3G, in some implementations, the spring 326—in this example, a torsion spring having a spiral shape—is disposed in the return housing 322 and includes an outer tang 350 and an inner tang 352. The inner tang 352 is held inside a notch 354 of the shaft 328 (e.g., adhered inside the notch 354 or otherwise affixed inside the notch 354). The outer tang 350 is held inside a notch 356 of the return housing 322 (e.g., adhered inside the notch 356 or otherwise affixed inside the notch 356). The spring 326 as a whole is wound around the common axis of the direct drive brake system (e.g., around the shaft 328). In response to rotation of the shaft 328 in a first direction, the spring 326 is wound up and placed under torsional stress, storing potential energy. This potential energy can be released as a return torque in the opposite direction to drive recovery phase rotation. In this example, the spring 326 winds about the same axis that the spool 332 and flywheel 310 rotate about.

Other types of return mechanism can instead or additionally be used. For example, a coil spring can be used to provide the return torque.

Figure 3E:
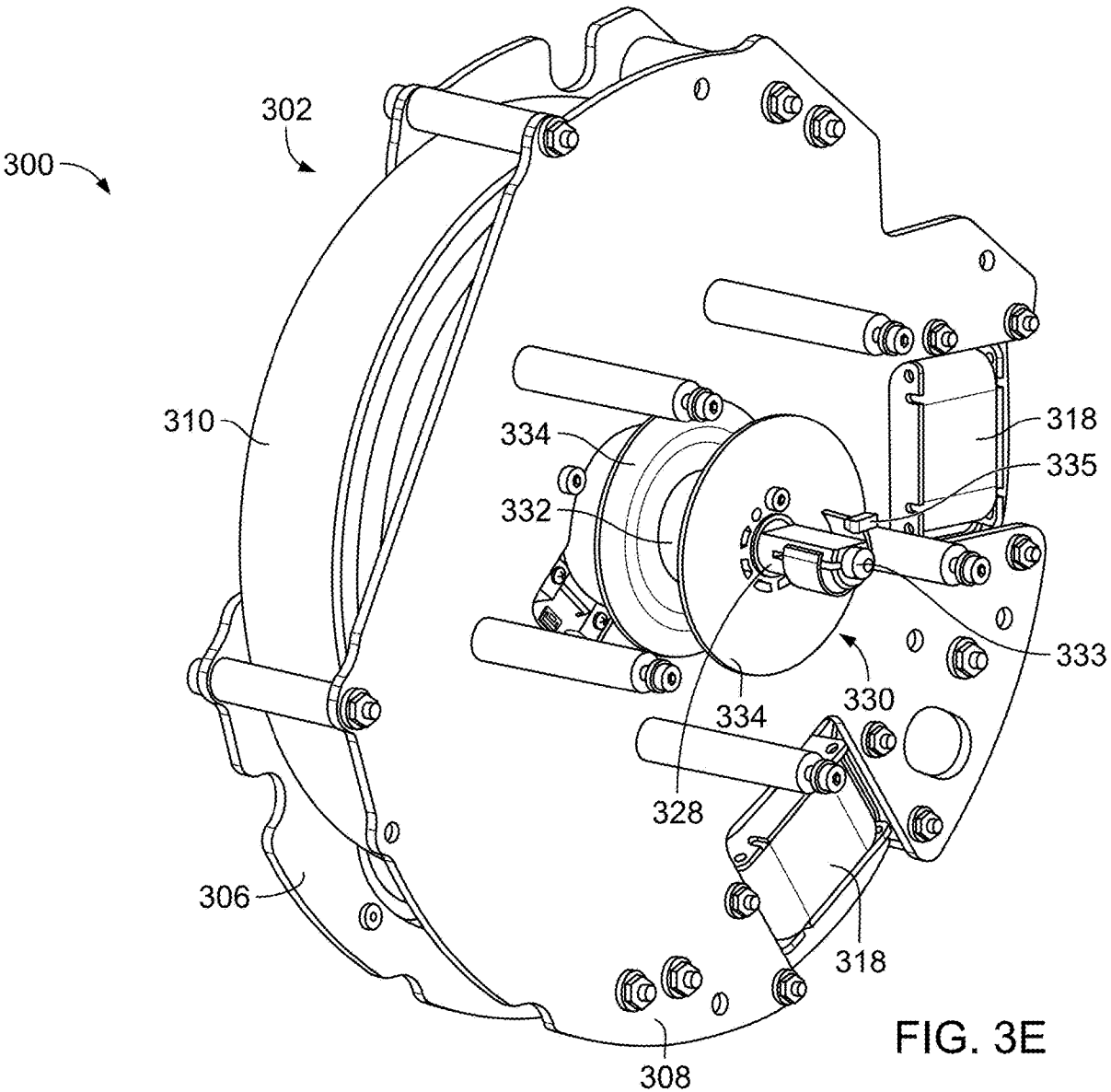

FIG. 3E shows the direct drive brake system 300 with the return assembly 320 removed, to expose a spool assembly 330. The spool assembly 330 includes a spool 332 (e.g., as described for spool 214) and two disc-shaped strap guides 334 (e.g., as described for strap guides 216). The spool 332 is configured to attach to a strap (not shown), e.g., by one or more of an adhesive, clip(s), teeth, screw(s)/bolt(s), or another attachment device. Movement of the strap causes corresponding movement (e.g., rotation) of the spool 332. A shoulder bolt 335 fastens the strap to the spool 332.

The spool 332 is mechanically coupled to (e.g., attached to) the shaft 328. For example, in some implementations the spool 332 is attached to an outer circumference of the shaft 328. Rotation of the spool 332 accordingly causes corresponding rotation of the shaft 328, e.g., at a rotational velocity matching a rotational velocity of the spool 332.

In some implementations, the spool has a gradually-changing radius that accounts for a thickness of the strap, in order to avoid an abrupt change in strap position when the spool completes a rotation of the spool. As shown in FIG. 3H, a spool 360 defines a shaft aperture 364 through which a shaft passes to rotate with the spool 360. The spool 360 also defines an anchoring aperture 362 through which an anchoring pin for a strap can be provided. The strap (not shown) is fixed by the anchoring pin and wraps in a counter-clockwise direction around the spool 360. The radius 366 of the spool 360 gradually increases in the clockwise direction from the anchoring aperture 362, and a difference 368 between the radius 366 at the anchoring aperture 364 and the radius 366 at the completion of a revolution around the spool 360, immediately before the anchoring aperture, matches a thickness of the strap (in this example, 0.8 cm inches). Accordingly, the strap, after completion of the revolution, can be wound smoothly against itself without a sudden bump. The spiral design of the spool can, in some implementations, reduce wear on the strap and improve the reliability and stability of force transmission through the spool-strap system. Spools having spiral shapes, such as the spool 360, can be used as the spool in any of the systems described in this disclosure, such as in direct drive brake systems 200, 300, 400 or in conjunction with the return assembly 500.

Figure 3F:
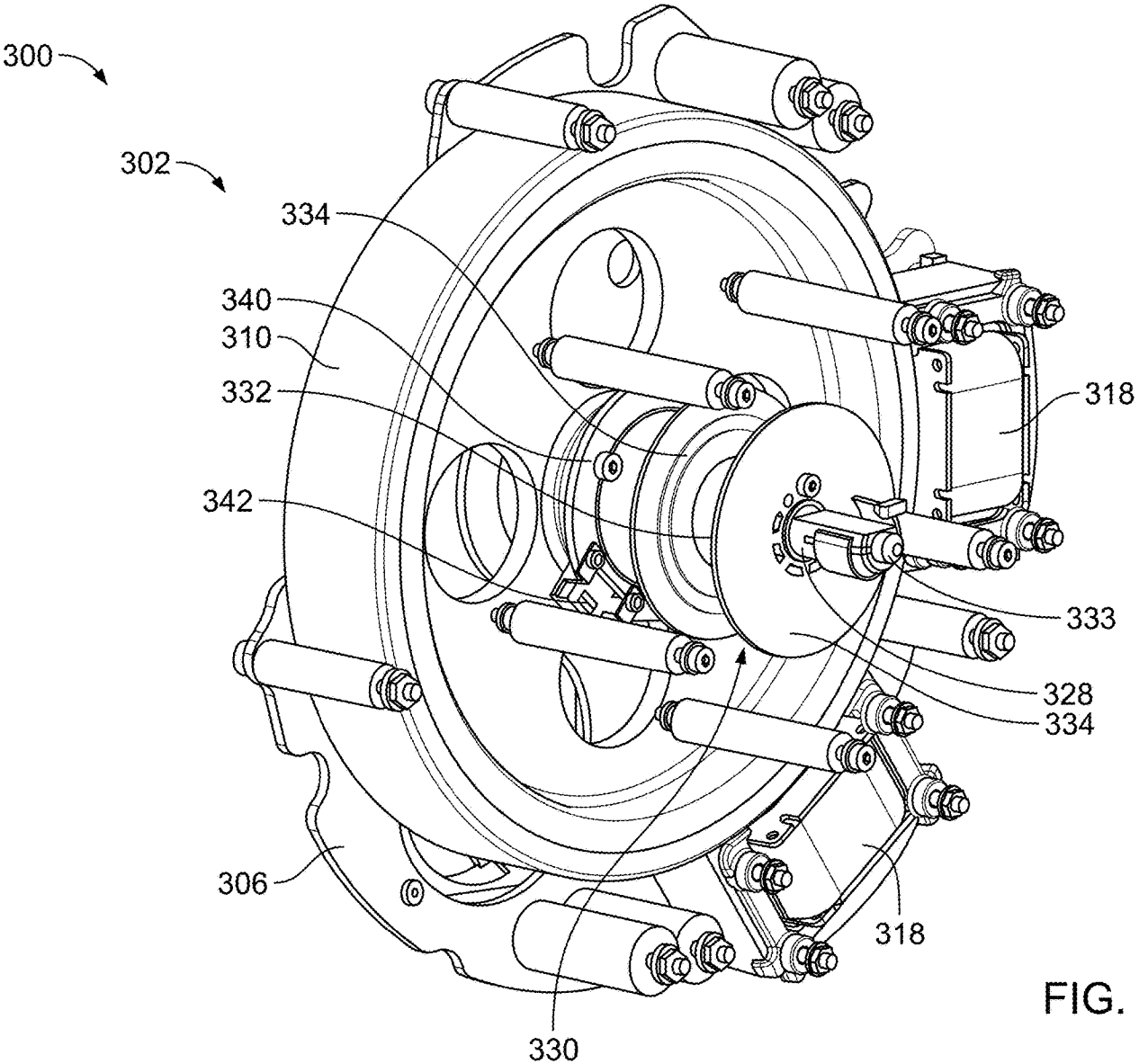
Figure 3G:
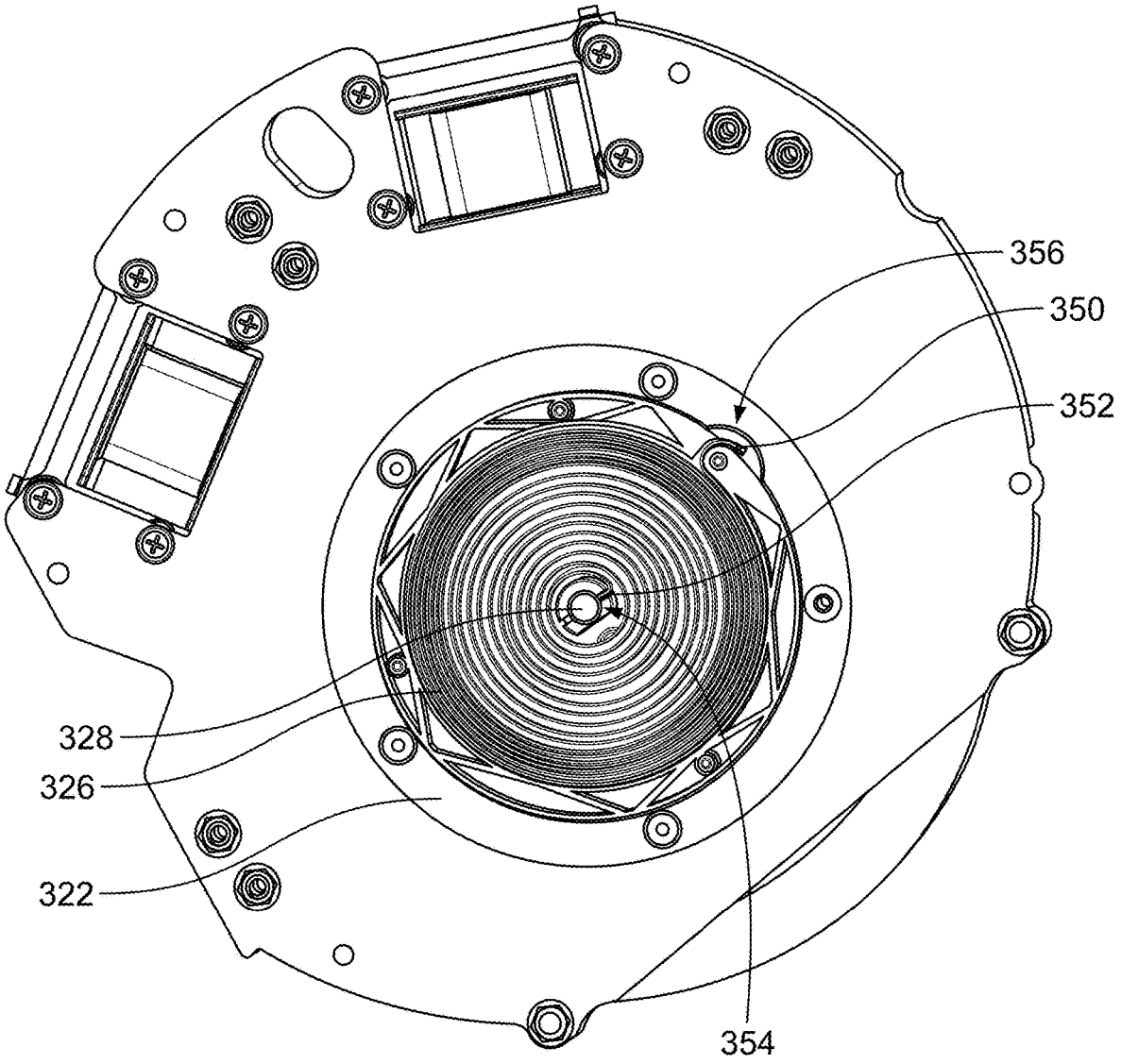
Figure 3H:
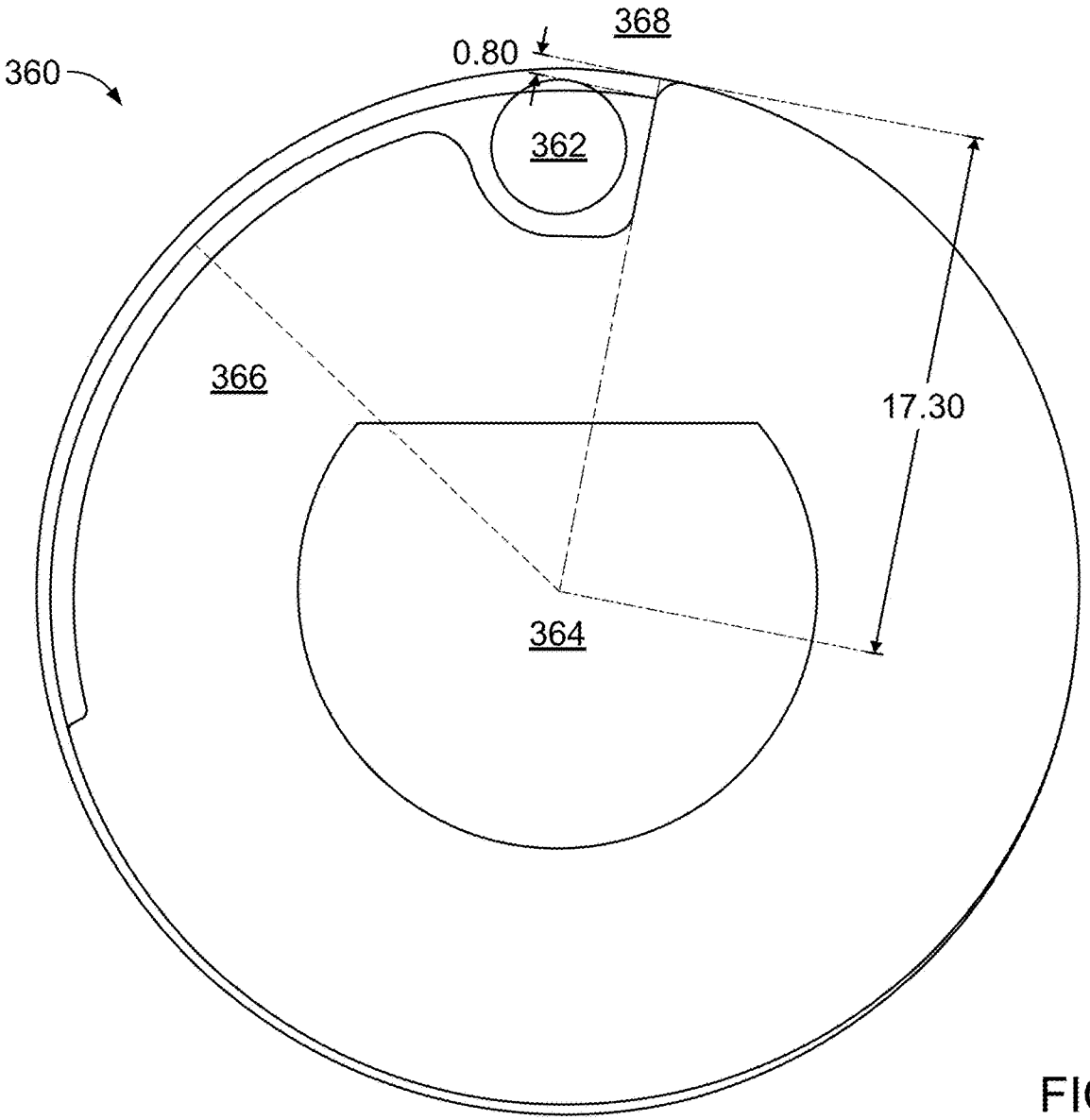

FIG. 3F shows the direct drive brake system 300 with the return assembly 320 and plate 308 removed to expose an interior of the frame 304. The shaft 328 extends through the spool assembly 330 and couples to the flywheel 310 through a clutch as described for clutch 240 (not shown), which can be a one-way clutch or another type of clutch, as described above. The clutch is configured to engage and disengage with the shaft 328 to active and deactivate transfer of torque/motion between the shaft 328 and the flywheel 310. A cover 340 encloses ball bearings that maintain separation between rotating and non-rotation components, e.g., as described for covers 226 and ball bearings 228. A flywheel sensor 342, operating in an analogous fashion to the shaft sensors 260, 327, and including any or all of the components described in reference to the shaft sensors 260, 327, is configured to measure position and/or angular velocity of the flywheel 310. For example, in some implementations the flywheel sensor 342 includes a magnetic encoder configured to detect magnetic field variations caused by rotation of magnetic poles embedded in the flywheel 310. For example, the magnetic poles can be embedded in the flywheel 310 in a ring such that they are aligned with a magnetic field sensor of the flywheel sensor 342. The magnetic poles can be in a magnet that rotates with the flywheel without having to be embedded in the flywheel 310. In some implementations, the flywheel sensor 342 includes one or more connection components by which measurements taken by the flywheel sensor 342 can be transmitted to other components, such as to brake controller 110.

Figure 4:
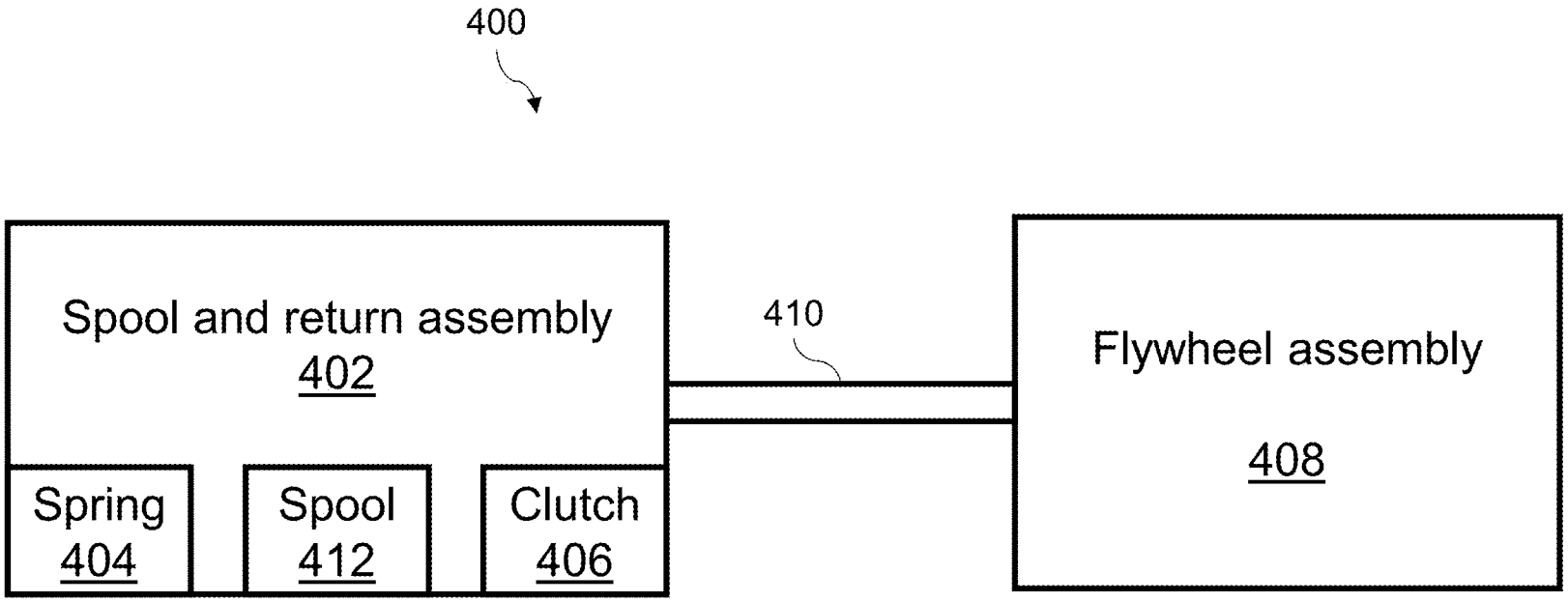
FIG. 4 is a diagram illustrating an example direct drive brake system.

In some implementations, instead of or in addition to a clutch in the flywheel assembly, a clutch is instead integrated into the spool assembly to engage and disengage transmission of torques between the spool and the shaft. As shown in FIG. 4, an alternative direct drive brake system 400 includes a combined spool and return assembly 402. The spool and return assembly 402 can have any or all of the characteristics described in reference to spool assemblies 202 and 300. For example, the spool and return assembly 402 can be configured to attach to a strap that is pulled by a user.

The spool and return assembly 402 includes a clutch 406 that couples a spool 412 of the spool and return assembly 402 (e.g., described for spool 214) to a shaft 410. The shaft 410 is coupled to a flywheel in a flywheel assembly 408, which can have any or all of the characteristics described in reference to flywheel assemblies 204, 302. However, the flywheel assembly 408 need not (but can) include a clutch between the shaft 410 and the flywheel.

The clutch 406 is configured to engage and disengage transmission of torque between the spool 412 and the shaft 410. The clutch 406 can be configured to engage torque transmission during a drive phase of a stroke, and to disengage torque transmission during a recovery stage of a stroke. For example, the clutch can be a one-way clutch configured to engage torque transmission when the spool's rotational speed matches or exceeds that of the shaft 410. Accordingly, during the drive phase, braking torques applied by the flywheel are transmitted to the spool 412 and felt by a user holding a strap coupled to the spool 412, as the user unwinds the strap from the spool 412. During the recovery phase, the spool 412 is disengaged from the shaft 410; the shaft 410 can continue to spin with the flywheel.

The clutch 406 can have any or all of the characteristics described for clutch 240, except that the clutch 406 engages and disengages the shaft 410 with the spool 412 rather than with the flywheel. For example, the clutch 406 can be a roller clutch, a ratchet clutch, a sprag clutch, or a needle-bearing clutch, or another type of clutch (e.g., a controlled clutch that need not be a one-way clutch). The clutch 406 can be positioned so as to engage with an outer circumference of the shaft 410 and with an inner edge of the spool 412. The clutch 406 can be arranged within a footprint of (e.g., concentrically within) the spool 412.

In order to provide a return torque to the spool 412, the spool and return assembly 402 also includes a return mechanism, such as a spring 404, that is coupled to the spool 412 in a manner that bypasses the shaft 410. For example, the spring 404 can be coupled directly to the spool 412. Accordingly, the spring 404 is configured to impart torques onto the spool 412 even when the clutch 406 is not engaging the spool 412 with the shaft 410, e.g., the spring 404 can be continuously mechanically coupled to the spool 412. This can allow the spring 404 to impart a return torque on the spool 412 (and, accordingly, on a strap) during a recovery phase of a stroke, even when the clutch 406 has disengaged the spool 412 from the flywheel. The spring 404 can have characteristics as described for spring 326. For example, the spring 404 can be a spiral torsion spring attached, at a first tang, to the spool 412 or to another component mechanically coupled to the spool 412, and can also be attached, at a second tang opposite the first tang, to a non-rotating component. Rotation of the spool 412 causes torsional stress in the spring 404 that can subsequently be released to drive opposite rotation of the spool 412.

In some implementations, the spool assembly and the flywheel assembly are arranged to rotate around a first common axis, and the return assembly is arranged to rotate at least partially around a second, different axis. As described below, this configuration can reduce a number of rotations performed by the spring of the return assembly, improving spring reliability.

Figure 5A:
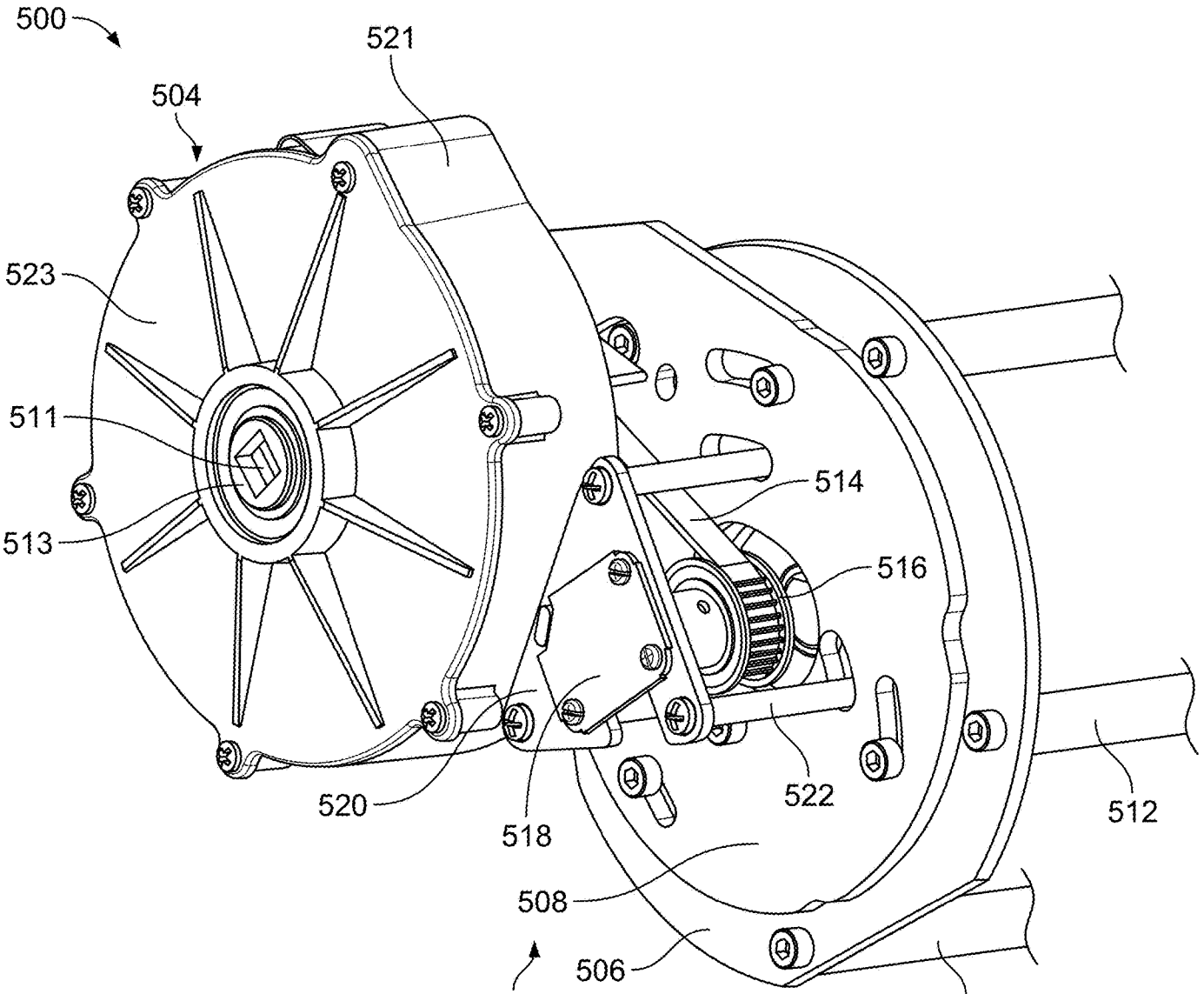
FIGS. 5A-5E are diagrams illustrating an example brake system.

As shown in FIG. 5A, a return assembly 500 includes a gear stage 502 and a return stage 504. The gear stage 502 includes a base plate 506 and a tensioner plate 508, through which a brake shaft 510 (shown in FIG. 5B) extends. The brake shaft 510 is torqued by a spool of a spool assembly and by a flywheel of a flywheel assembly (these assemblies generally not being shown in FIGS. 5A-5E for clarity), such that the brake shaft 510 can have any or all of the characteristics and purposes described for shafts 212 and 328 above, except that the brake shaft 510 is not directly torqued by an on-axis torque of a return mechanism of the return assembly 500 but, rather, receives return torque using a belt 514 that moves in response to rotation of the return mechanism about a second axis. The spool assembly and flywheel assembly that operate in conjunction with the return assembly can have any or all of the characteristics described for spool assemblies 202, 330 and return assemblies 208; for example, a spool of the spool assembly and a flywheel of the flywheel assembly are coupled by the brake shaft 510 and are configured to rotate about a common axis, and a clutch of the flywheel assembly can engage and disengage adjustable braking torques applied by the flywheel.

Standoffs 512 attached to the base plate 506 attach the gear stage 502 to another portion of the brake system that includes the return assembly 500; for example, the standoffs 512 can be attached to a plate 509 of the flywheel assembly (shown in FIG. 5B) as described for standoffs 221.

The return assembly 500 also includes a gear stage sprocket 516 that is attached to the brake shaft 510 (e.g., by a set screw and a precision sliding fit). The belt 514 is secured against the gear stage sprocket 516 such that, when the gear stage sprocket 516 rotates due to rotation of the brake shaft 510, the belt 514 is moved correspondingly. Rotation of the brake shaft 510 can be measured using a handle encoder 518 mounted on an encoder plate 520 attached to the base plate 506 by standoffs 522. The handle encoder 518 can have characteristics as described above for encoders of the shaft sensors 260, 327. The handle encoder 518 is configured to detect rotation of the brake shaft 510, e.g., by detecting movement of magnetic poles of a magnet mounted on the brake shaft 510.

The belt 514 is also mechanically coupled to the return stage 504, as described in more detail below. The return stage 504 as shown in FIG. 5A includes a spring housing 521 and a spring housing cover 523 that enclose a spring, as described in more detail below. The spring housing 521 is attached to the tensioner plate 508, e.g., by screws. Rotation of the brake shaft 510 drives, via the belt 514, rotation of a spring shaft 511 coupled to the spring, such that the wound-up spring can exert a return torque on the spring shaft 511 and, via the belt 514, on the brake shaft 510. A shaft tool interface 513 allows for handling of the spring shaft 511.

Figure 5B:
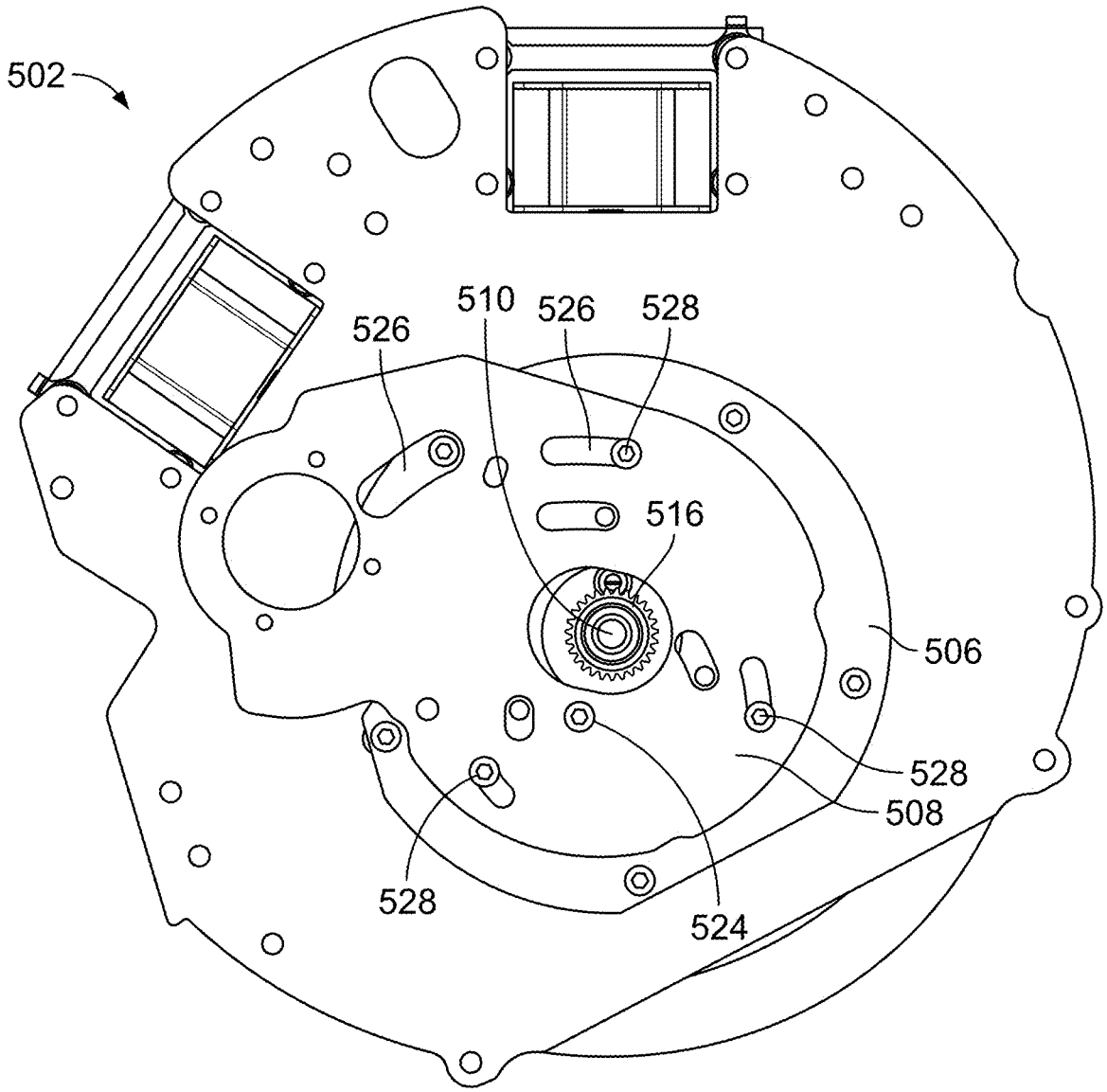

FIG. 5B shows how the tensioner plate 508 can be reconfigured to set tension in the belt 514. The tensioner plate 508 is attached to the base plate 506 by a center pivot screw 524 about which the tensioner plate 508 can pivot. Slots 526 in the tensioner plate 508 allow for pivoting of the tensioner plate 508 within a defined range. The tensioner plate 508 is attached to the spring housing 521 which carries a spring stage sprocket and the spring shaft 511, such that a degree of pivoting (eccentricity) of the tensioner plate 508 defines a distance between the spring shaft 511 and the brake shaft 510. This distance, accordingly, defines the tension in the belt 514. The tensioner plate 508 can be fixed in position, by tightening of tensioner lock screws 528, at a pivoting position/eccentricity that corresponds to a desired belt tension, setting the belt tension. This process can be performed, for example, as part of a calibration process at a manufacturing facility, and/or can be performed by users in case of belt slackening/tightening over time in order to re-set the desired belt tension.

Figure 5C:
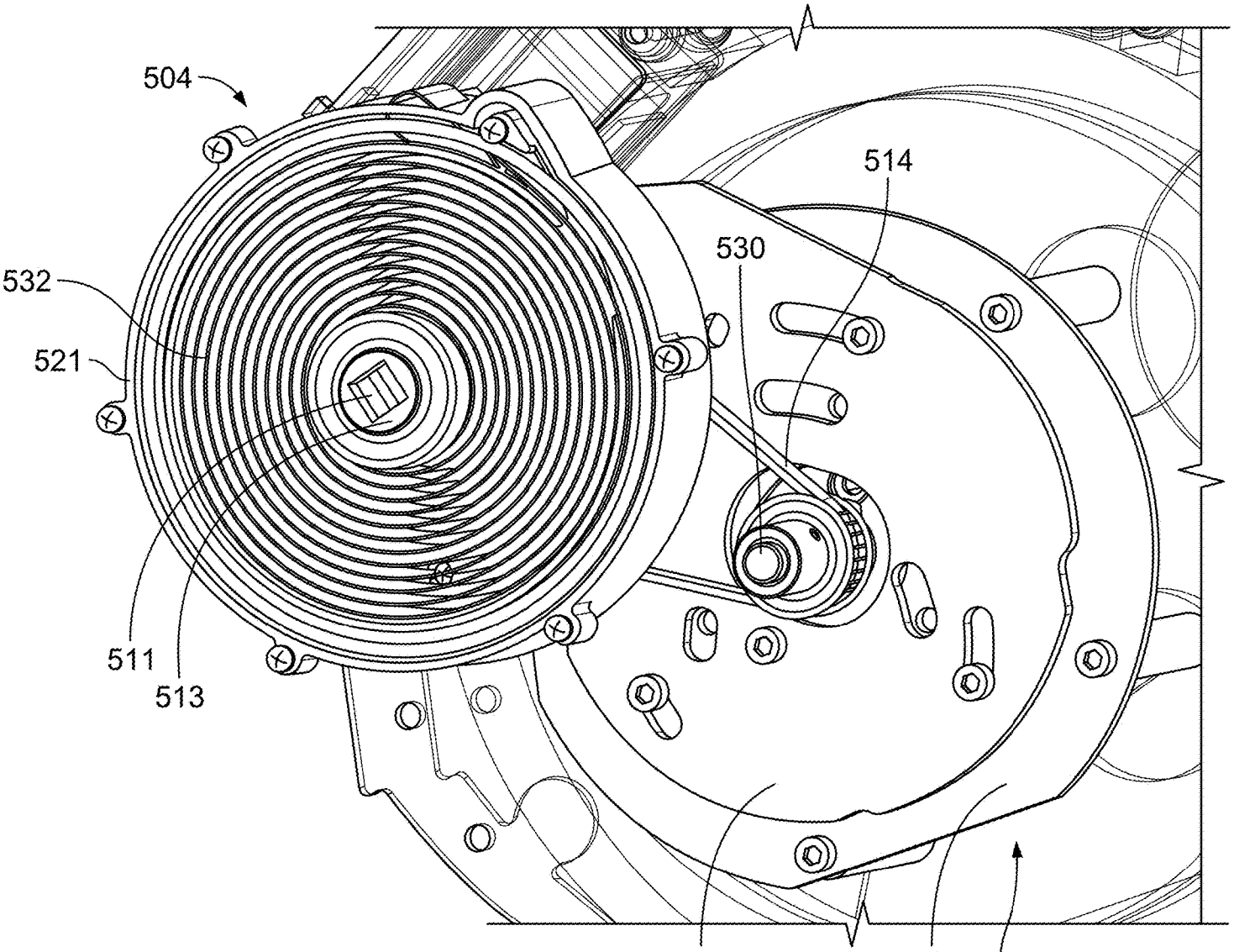

FIG. 5C shows the return assembly 500 with the spring housing cover 523 and the encoder plate 520 removed to expose underlying components. A handle encoder magnet 530, mounted on the brake shaft 510 so as to rotate with the brake shaft 510, generates an associated magnetic field that can be sensed by an encoder mounted on the encoder plate 520 to determine a rotational speed of the brake shaft 510 and/or an absolute rotational position of the brake shaft 510. Within the spring housing 521, a spring 532 is attached (e.g., at a first tang) to the spring shaft 511, and is attached (e.g., at a second tang) to a non-rotating component such as the spring housing 521. The spring 532 can have the characteristics described for other springs described in this disclosure, such as spring 326. Accordingly, when the spring shaft 511 rotates in a first direction, the spring 532 is wound up (e.g., in a drive phase of a rowing stroke), and the spring 532 subsequently drives rotation of the spring shaft 511 in a second direction (e.g., in a recovery phase of the rowing stroke). The spring 532 is arranged around the axis of the spring shaft 511 and around the spring shaft 511, where the axis of the spring shaft 511 is different from the axis of the brake shaft 510. The return torque applied by the spring 532 is applied on the axis of the spring shaft 511 and is transferred from that axis to the axis of the brake shaft 510, which is common to the spool and the flywheel.

Figure 5D:
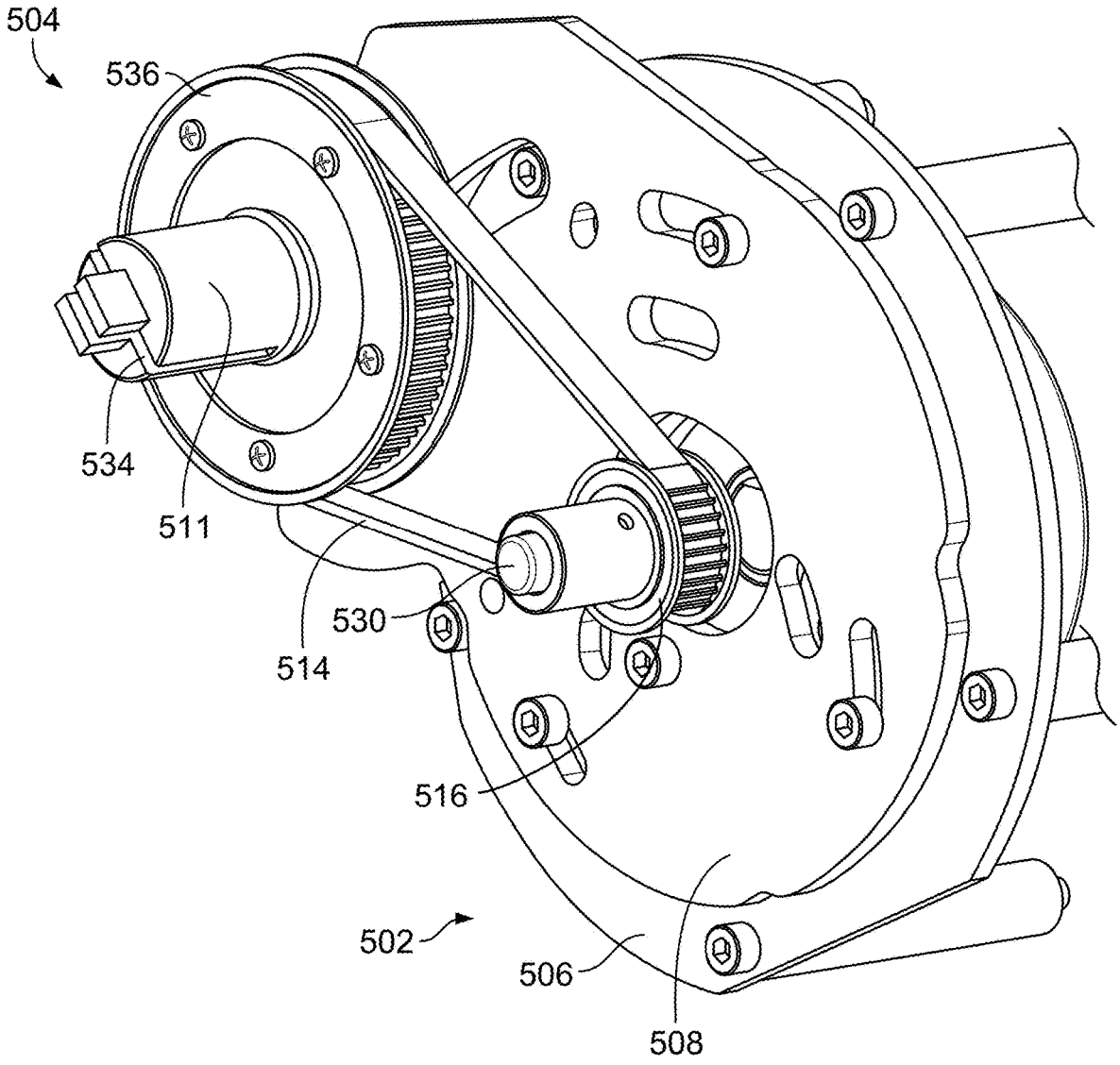

FIG. 5D shows further components of the return stage 504, with the spring 532 not shown for clarity. The spring shaft 511 includes a notch 534 in which a tang of the spring 532 can be attached. The spring shaft 511 is attached to (rotates with) a return stage sprocket 536, which receives the belt 514. Accordingly, as the spring shaft 511 rotates relative to the spring housing 521, the spring 532 deforms, and the spring 532 applies torque on the spring shaft 511 proportional to the spring's rotational offset from its resting position. The spring shaft 511 transmits this torque to the return stage sprocket 536, which transmits the torque to the brake shaft 510 via the belt 514 and the gear stage sprocket 516.

In some implementations, as in the example return assembly 500, the return stage sprocket 536 has a larger radius than the gear stage sprocket 516, as defined at the portion of each at which the belt 514 runs. For example, for matching tooth-to-tooth pitches between the return stage sprocket 536 and the gear stage sprocket 516, the return stage sprocket 536 can have more teeth than the gear stage sprocket 516. For example, the radius of the return stage sprocket 536 can be greater than 1.5 times, greater than 2 times, or greater than 2.5 times the radius of the gear stage sprocket 516, in various implementations. In some implementations, the radius of the return stage sprocket 536 is less than 5 times the radius of the gear stage sprocket 516. In some implementations, a tooth count of the return stage sprocket 536 is greater than 1.5 times, greater than 2 times, or greater than 2.5 times the tooth count of the gear stage sprocket 516. In some implementations, the tooth count of the return stage sprocket is less than 5 times the tooth count of the gear stage sprocket 516.

A larger size of the return stage sprocket 536 compared to the gear stage sprocket 516 can provide advantages for operation of the brake system including the return assembly 500. Because of the larger size, the spring shaft 511 rotates less than one time per single rotation of the brake shaft 510. For example, in the case of a 72-tooth return stage sprocket 536 and a 28-tooth gear stage sprocket 516, the spring shaft 511 rotates once per 2.57 rotations of the brake shaft 510. Correspondingly, each rotation of the brake shaft 510 yields less than a full rotation of the spring 532 (e.g., in the 72-tooth and 28-tooth example, a single rotation of the brake shaft 510 yields 0.389 rotations of the spring 532). This means that a number of rotations that the spring 532 must reliably tolerate over a lifetime of the return assembly 500 is reduced, compared to if the spring 532 rotated one-to-one with the brake shaft 510, improving overall brake reliability and durability. Correspondingly, in some implementations a stronger spring can be used because of the relaxed durability tolerance. This configuration can also provide for quieter operation by reducing noise associated with spring rotation.

Figure 5E:
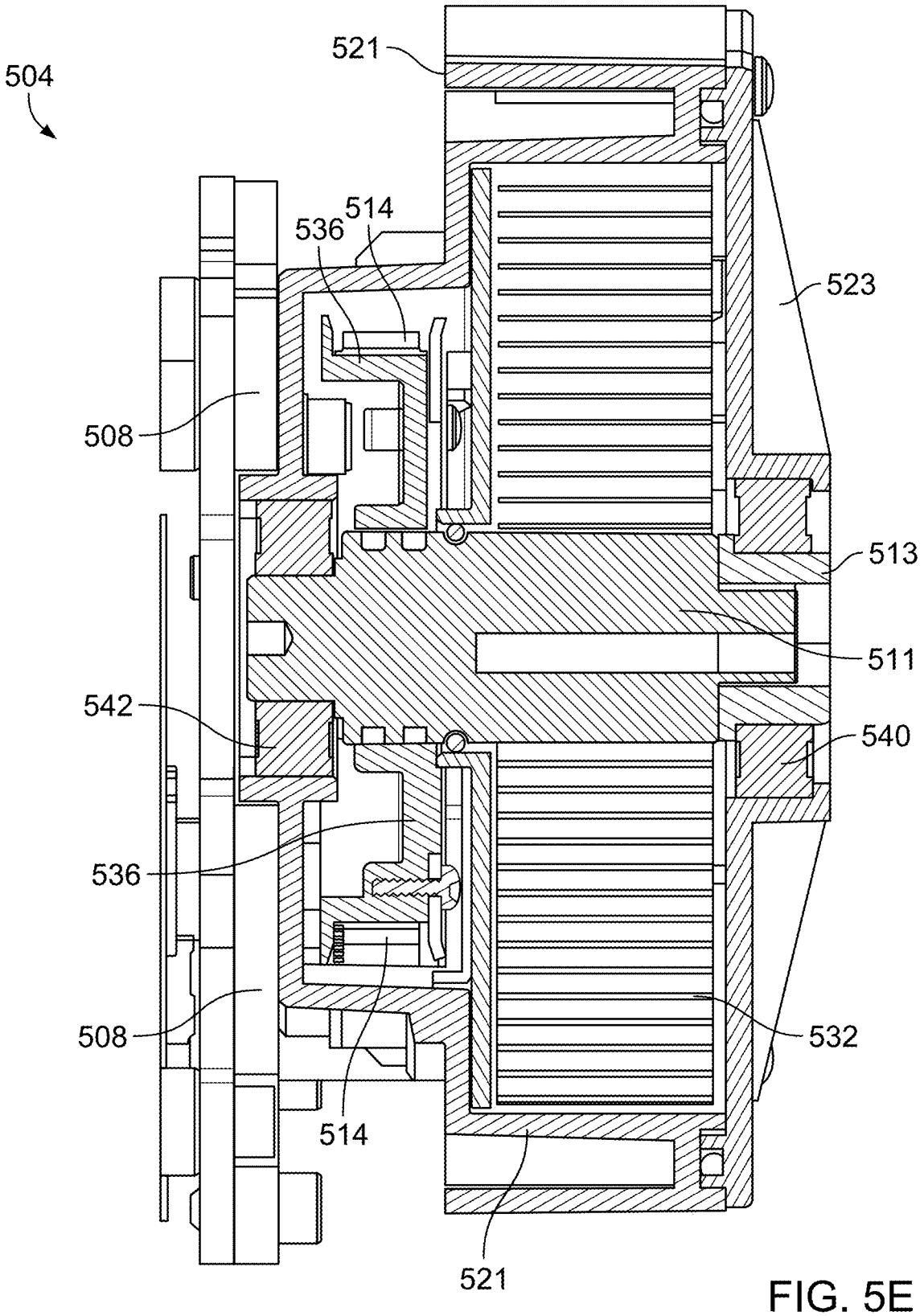

FIG. 5E shows the return stage 504 in a sectional profile view. The return stage sprocket 536, in this example, is partially enclosed within the spring housing 521, such that the belt 514 on the gear stage sprocket 536 is also partially enclosed within the spring housing 521. An inboard bearing 540 and an outboard bearing 542 respectively allow the spring shaft 511 to rotate with respect to fixed components of the return stage 504.

Figure 6:
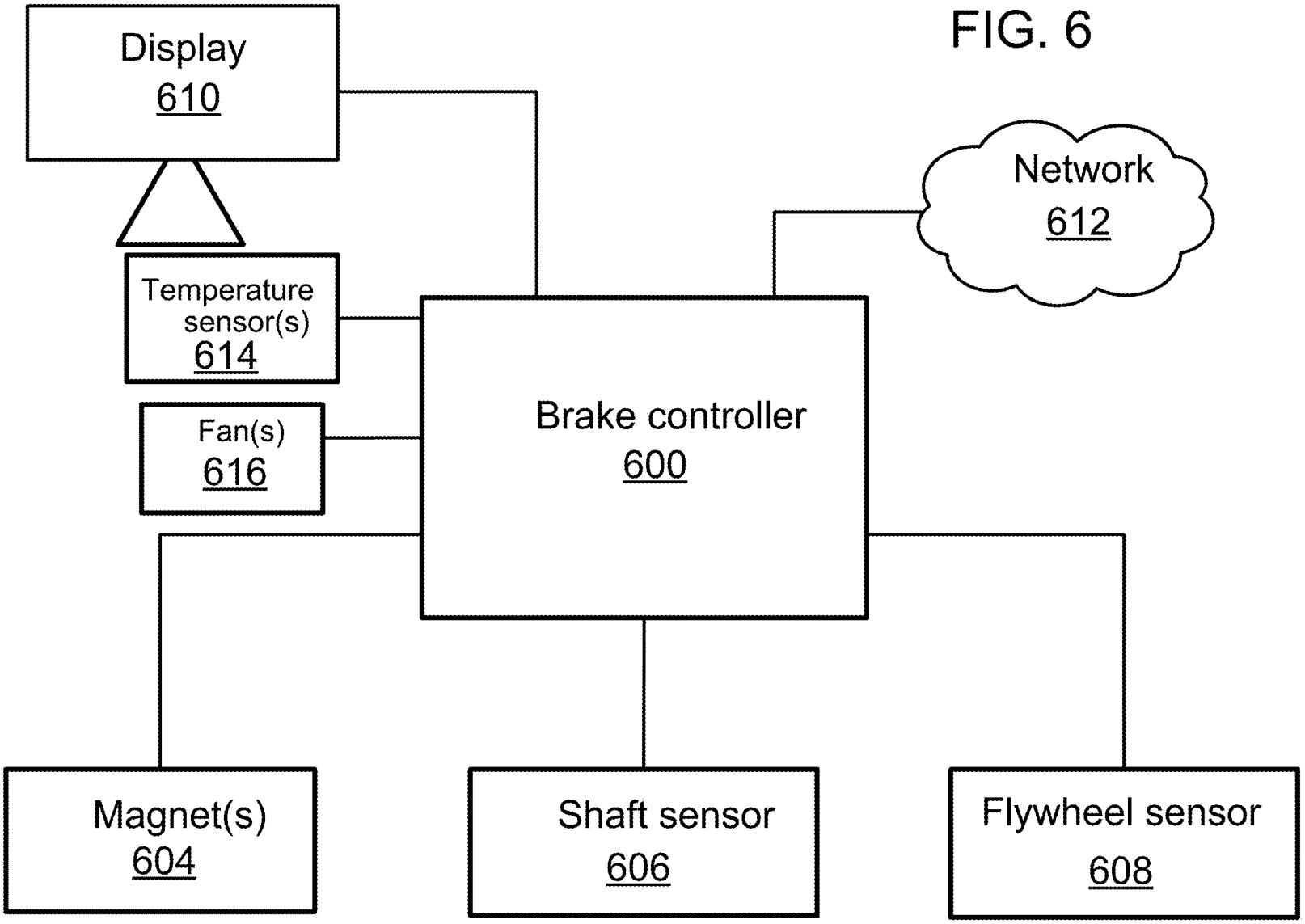
FIG. 6 is a diagram illustrating an example brake controller and associated components.

As noted above, in some implementations a brake controller is configured to control operations of the brake system. FIG. 6 shows an example brake controller 600 in communication with components of a brake system such as the direct drive brake systems or off-axis return-stage brake systems described in this disclosure. The brake controller 600 is a computer system, e.g., including one or more processors, as described in further detail below. In some implementations, the brake controller 600 is "local," e.g., enclosed in or otherwise/coupled to the exercise machine chassis. In some implementations, the brake controller 600 is at least partially remote, e.g., at least partially implemented as a remote computer system coupled to a local portion of the brake controller 600 of the exercise machine by a network, such as network 612.

The brake controller 600 is communicatively coupled to a shaft sensor 606 (e.g., shaft sensor 260, shaft sensor 327, or handle encoder 518) and to a flywheel sensor 608 (e.g., flywheel sensor 342) and is configured to receive signals from the sensors 606, 608 indicative of respective rotational positions and/or angular velocities of the shaft and flywheel, respectively. For example, the signals can include electrical and/or optical signals. In some implementations, the brake controller 600 is configured to analyze an encoded signal (e.g., an analog signal directly representative of a time-varying sensed magnetic field) to determine the position/velocity information. In some implementations, at least some pre-processing is performed at the sensors 606, 608 (e.g., by integrated circuits of the sensors 608, 608), such that the brake controller 600 can directly receive the position/velocity information from the sensors 606, 608, e.g., in a digital form. As noted above, in some implementations a flywheel sensor 608 is not included in the exercise machine.

The brake controller 600 is also coupled (e.g., electrically coupled) to one or more magnets 604 by which the brake controller 600 can control a magnetic field strength applied by the magnets 604 and, accordingly, a braking force applied by a flywheel. For example, in some implementations, the magnets 604 are electromagnets, and the brake controller 600 is configured to adjust currents through the magnets 604. Control objectives/methods of the brake controller 600 can vary depending on the implementation. In some implementations, the brake controller 600 is configured to adjust currents through the magnets 604 in order to set a target resistance to motion (torque/force) caused by the flywheel. The target resistance to motion can be a time-varying resistance to motion in accordance with an exercise program selected by a user of the exercise machine, a constant resistance to motion to mimic weight-lifting, etc. In some implementations, the brake controller implements an algorithm that, for a given target resistance to motion, outputs a current to be applied to the magnets 604. The algorithm can take, as inputs, measurements from one or both of the shaft sensor 606 or the flywheel sensor 608 (the measurements representing a current state of the exercise machine), and apply the measurements to an internal, stored model of the exercise machine in order to derive the current to be applied. Further details on control and calibration methods that can be implemented using the brake controller 600 can be found in U.S. Pat. No. 10,828,531, the entirety of which is incorporated by reference herein.

In some implementations, control operations performed by the brake controller 600 are more reliable and/or accurate because of the configurations of the brake systems described herein. For example, because multiple assemblies of a brake system are integrated onto (e.g., rotate about) a single axis, measurement of rotation for a first assembly is directly representative of rotation for one or more other assemblies, reducing measurement error and, therefore, leading to more accurate imposition of target resistances to motion as determined by the algorithm of the brake controller 600. The brake systems described herein can be more accurately calibrated initially and/or can have more stable mechanical characteristics over time (e.g., because of integration of multiple assemblies onto a single axis), which can similarly lead to more accurate target resistances to motion. The user experience of the exercise machine including the brake systems accordingly can be a more realistic simulation of real-world conditions (e.g., rowing on a river) and can be more stable over and/or between different exercise machines each including a direct drive brake system. For brake systems that include an off-axis return stage, the off-axis return stage can be configured to reduce a number of spring rotations, which can lead to more stable spring behavior over time, thereby improving the accuracy of calculations by the brake controller 600 that incorporate information about return torques applied by the spring.

In some implementations, the brake controller 600 is communicatively coupled to a display 610 (e.g., display 114). The brake controller 600 can be configured to cause the display 610 to display user interfaces such as menus for selection of exercise programs/scenarios, performance information based on measurements (e.g., a distance rowed or pedaled based on rotational information from the shaft sensor 606), and/or other information. In some implementations, the display 610 is a touchscreen display that can receive interactions from a user to select exercise programs/scenarios and other user-configurable settings to control the brake controller 600, including to control network communications.

In some implementations, the brake controller 600 is communicatively coupled to a network 612, such as one or more wired and/or wireless networks, e.g., cellular, WiFi, and other networks. For example, the brake controller 600 can be connected to the Internet and, through the internet, receive information such as information about usage of other exercise machines that are also connected to the internet. In some implementations, based on this information, the brake controller 600 can implement competitive and/or cooperative exercise activities, such as group exercise in a shared scenario.

In some implementations, the brake controller 600 is configured to control active cooling of a flywheel assembly (e.g., of a flywheel and/or of one or more other components). The brake controller receives, from one or more temperature sensor 614, data indicative of temperatures sensed at the flywheel assembly, and controls one or more fans 616 based on the temperatures. For example, in an on/off mode of operation, if the sensed temperatures satisfy a condition (e.g., are above a threshold temperature) then the brake controller 600 enables/disables the fans 616. As another example, the brake controller 600 can control the fans 616 to operate at a higher intensity (e.g., higher rotational speed) for higher sensed temperatures.

Examples of user interfaces and user experiences that can be provided via the display 610 and network 612 based on control by the brake controller 600 can be found in U.S. Pat. No. 10,471,297 and in U.S. application Ser. No. 17/001,285.

Couplings between the brake controller 600 and other components shown in FIG. 6 can be wired connections (e.g., by wires and/or cables) and/or wireless connections (e.g., by short-range wireless signals).

Variations of the above-described brake systems are within the scope of this disclosure. For example, although the direct drive brake systems 200, 300 include spool assemblies positioned between return assemblies and flywheel assemblies, in some implementations these assemblies are arranged in an alternative order. For example, in some implementations the order of assemblies can be spool assembly, return assembly, flywheel assembly, or another order. Moreover, there need not be three separate assemblies; rather, in some implementations the functionalities described herein can be combined into one or two assemblies that together include a return mechanism, a flywheel with adjustable eddy-current torque, and a mechanism coupled to a strap to rotate a shaft, such as described in reference to FIG. 4.

Various implementations of the systems and techniques described here, such as the brake controller, can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable processing system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" or "computer-readable medium" refer to any non-transitory computer program product, apparatus and/or device (e.g., magnetic discs, optical disks, memory, Programmable Logic Devices (PLDs)) used to provide machine instructions and/or data to one or more programmable processors, including a machine-readable medium that receives machine instructions.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

This specification uses the term "configured" in connection with systems and computer program components. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by the data processing apparatus, cause the apparatus to perform the operations or actions.

Although a few implementations have been described in detail above, other modifications are possible. Logic flows depicted in the figures do not require the particular order shown, or sequential order, to achieve desirable results. In addition, other actions may be provided, or actions may be eliminated, from the described flows, and other components may be added to, or removed from, the described systems. Accordingly, other implementations are within the scope of the following claims.

What is claimed is:

1. An exercise machine, comprising:

a shaft configured to rotate about an axis;

a spool configured to receive a strap and, in response to movement of the strap, rotate about the axis and drive rotation of the shaft about the axis;

a flywheel configured to rotate about the axis;

two or more conductive coils arranged to generate magnetic fields that induce eddy currents in the flywheel, the two or more conductive coils arranged radially outside the flywheel;

a clutch configured to engage and disengage transmission of torque between the spool and the flywheel; and a spring arranged around the axis, the spring configured to exert a return torque on the spool about the axis in response to rotation of the shaft, the return torque causing the spool to rotate about the axis.

2. The exercise machine of claim 1, wherein the clutch is configured to engage and disengage transmission of torque between the shaft and the flywheel.

3. The exercise machine of claim 2, wherein the clutch is arranged within a footprint of the flywheel.

4. The exercise machine of claim 1, wherein the clutch engages with an outer circumference of the shaft.

5. The exercise machine of claim 1, wherein the clutch is configured to engage and disengage transmission of torque between the shaft and the spool, and wherein the spring is coupled to the spool over a torque transmission path that bypasses the shaft.

6. The exercise machine of claim 1, wherein the shaft comprises an integrally-formed shaft extending to each of the spool, the flywheel, and the spring.

7. The exercise machine of claim 1, wherein the spring is attached to the shaft.

8. The exercise machine of claim 1, comprising a handle coupled to the strap.

9. The exercise machine of claim 1, wherein the spool is arranged between the flywheel and the spring.

10. The exercise machine of claim 1, wherein the spool has a radius that increases in a winding direction of the strap on the spool.

11. The exercise machine of claim 1, wherein the exercise machine is a rowing exercise machine.

12. The exercise machine of claim 1, wherein the clutch is a one-way clutch.

13. The exercise machine of claim 1, wherein the spring is a torsion spring.

14. The exercise machine of claim 1, comprising at least one encoder configured to measure rotation of at least one of the shaft or the flywheel.

15. The exercise machine of claim 1, wherein the transmission of torque between the spool and the flywheel occurs along only the axis.

16. The exercise machine of claim 1, wherein the transmission of torque between the spool and the flywheel occurs without a gearing reduction between the spool and the flywheel.

17. The exercise machine of claim 1, wherein the transmission of torque between the spool and the flywheel occurs without a belt between the spool and the flywheel.

* * * * *